US009632443B2

(12) United States Patent
Noda et al.

(10) Patent No.: US 9,632,443 B2
(45) Date of Patent: Apr. 25, 2017

(54) POWDER COATING APPARATUS AND NON-TRANSITORY COMPUTER READABLE MEDIUM

(71) Applicant: FUJI XEROX CO., LTD., Tokyo (JP)

(72) Inventors: Akihiko Noda, Kanagawa (JP); Makoto Furuki, Kanagawa (JP); Masato Mikami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/594,758

(22) Filed: Jan. 12, 2015

(65) Prior Publication Data

US 2016/0082469 A1 Mar. 24, 2016

(30) Foreign Application Priority Data

Sep. 18, 2014 (JP) ..... 2014-190534

(51) Int. Cl.
*G03G 15/22* (2006.01)
*G03G 9/113* (2006.01)

(52) U.S. Cl.
CPC ..... *G03G 9/1131* (2013.01)

(58) Field of Classification Search
CPC ..... G03G 15/0233; G03G 15/0818; G03G 15/1685; G03G 15/221
USPC ..... 399/130
See application file for complete search history.

(56) References Cited

U.S. PATENT DOCUMENTS 5,149,941 A * 9/1992 Hirabayashi ..... G03G 15/2003 219/216
5,955,152 A * 9/1999 Yasuda ..... B82Y 15/00 430/124.14
6,262,513 B1 * 7/2001 Furukawa ..... H01L 21/56 257/E21.502
6,313,221 B1 11/2001 Yabuta et al.
2002/0086104 A1 7/2002 Yabuta et al.
2005/0165133 A1 7/2005 Sacripante et al.
2005/0208299 A1 * 9/2005 Minamida ..... B05C 1/0834 428/355 N
2007/0020552 A1 * 1/2007 Matsumoto ..... G03G 9/0827 430/111.35
2009/0232996 A1 * 9/2009 Goodreau ..... C23C 10/30 427/419.8

(Continued)

FOREIGN PATENT DOCUMENTS

JP A-8-272213 10/1996
JP A-10-43670 2/1998

(Continued)

*Primary Examiner* — Walter L Lindsay, Jr.
*Assistant Examiner* — Frederick Wenderoth
(74) *Attorney, Agent, or Firm* — Oliff PLC

(57) ABSTRACT

A powder coating apparatus includes a specific transport device that transports an object to be coated, and a specific applying unit, a specific heating device, and a specific control device, wherein the applying unit is disposed to oppose a surface to be coated of the transported object to be coated, applies a charged thermosetting powder coating material onto a surface to be coated of the object to be coated, and includes an applying section and a supplying section, the heating device heats a powder particle layer of the powder coating material so as to be thermally cured, and the control device controls a speed ratio between a transport speed of the object to be coated and a rotation speed of an applying member.

14 Claims, 7 Drawing Sheets

(56) References Cited

U.S. PATENT DOCUMENTS

| | | | | |
|---|---|---|---|---|
| 2013/0272765 | A1* | 10/2013 | Habu | G03G 15/6585 399/407 |
| 2014/0023408 | A1* | 1/2014 | Kato | G03G 15/0928 399/269 |

FOREIGN PATENT DOCUMENTS

| | | |
|---|---|---|
| JP | A-2000-221780 | 8/2000 |
| JP | A-2001-106959 | 4/2001 |
| JP | A-2005-211900 | 8/2005 |

* cited by examiner

POWDER COATING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2014-190534 filed Sep. 18, 2014.

BACKGROUND

1. Technical Field

The present invention relates to a powder coating apparatus and a non-transitory computer readable medium.

2. Related Art

In recent years, in a powder coating technique using a powder coating material, the amount of volatile organic compounds (VOC) emitted in a coating process is small and the powder coating material that has not been adhered to an object to be coated may be collected after the coating process in order to be recycled, and thus the technique has received attention in terms of the global environment.

Regarding an electrophotographic image forming apparatus using toner, various developing devices are known.

SUMMARY

According to an aspect of the invention, there is provided a powder coating apparatus including:

a transport device that transports an object to be coated; and an applying unit, a heating device, and a control device, wherein the applying unit is disposed to oppose a surface to be coated of the transported object to be coated, applies a charged thermosetting powder coating material onto a surface to be coated of the object to be coated, and includes an applying section having a cylindrical or columnar applying member that rotates in the same direction as a transport direction of the object to be coated and causes the powder coating material that adheres to a surface of the applying section to be transferred and applied onto the surface to be coated of the object to be coated by a potential difference between the applying section and the surface to be coated of the object to be coated, and a supplying section having a cylindrical or columnar supplying member that supplies the powder coating material onto a surface of the applying member, wherein the heating device heats a powder particle layer of the powder coating material applied onto the surface to be coated of the object to be coated, so as to be thermally cured, and wherein the control device controls a speed ratio between a transport speed of the object to be coated and a rotation speed of the applying member so that a thickness of the powder particle layer of the powder coating material applied by the applying unit onto the surface to be coated of the object to be coated becomes a predetermined thickness.

BRIEF DESCRIPTION OF THE DRAWINGS

Exemplary embodiments of the present invention will be described in detail based on the following figures, wherein.

DETAILED DESCRIPTION

Hereinafter, an exemplary embodiment as an example of the present invention will be described in detail with reference to the drawings.

Figure 1:
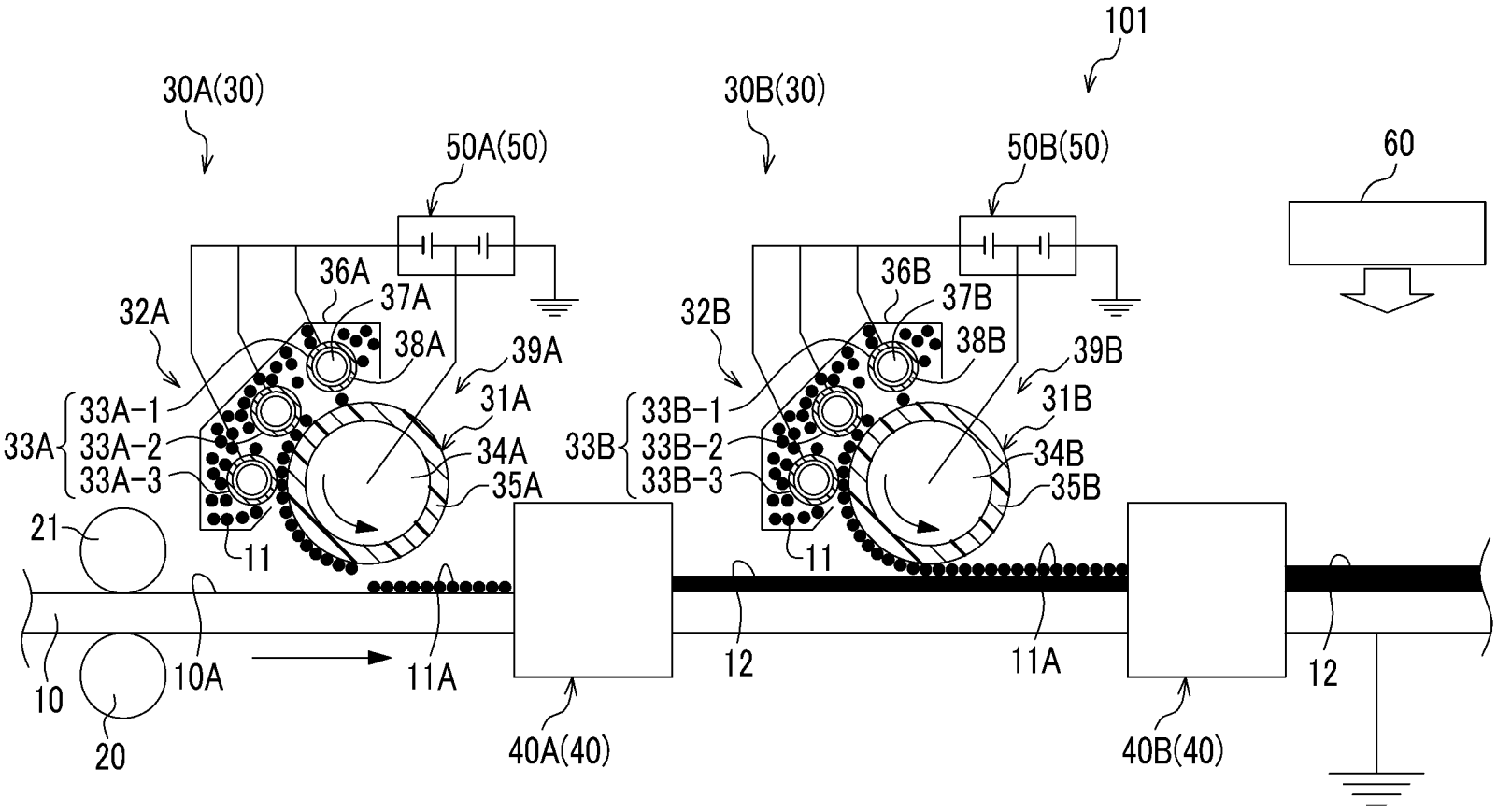
FIG. 1 is a schematic view illustrating an example of the configuration of a powder coating apparatus according to an exemplary embodiment.

FIG. 1 is a schematic view illustrating an example of the configuration of a powder coating apparatus according to the exemplary embodiment.

A powder coating apparatus 101 according to this exemplary embodiment includes, for example, as illustrated in FIG. 1, a transport device 20 which transports an object 10 to be coated, an applying unit 30 which is disposed to oppose a surface 10A to be coated of the transported object 10 to be coated and applies a charged thermosetting powder coating material 11 onto the surface 10A to be coated of the object 10 to be coated, and a heating device 40 which heats a powder particle layer 11A of the powder coating material 11 (hereinafter, also simply referred to as "powder particle layer 11A") applied onto the surface 10A to be coated of the object 10 to be coated, so as to be thermally cured. In addition, in the powder coating apparatus 101, a voltage applying device 50 which applies a voltage to each member to form a voltage difference is also included.

In addition, in the powder coating apparatus 101, a control device 60 which is connected to each device and each member in the powder coating apparatus 101 to control the operation of each device and each member is included.

(Object to be Coated)

Examples of the object 10 to be coated include a plate shape object made of metal, ceramic, or a resin. A surface treatment such as a primer treatment, a plating treatment, or an electrophoretic coating may also be performed in advance on the surface 10A to be coated of the object 10 to be coated.

The powder coating material 11 is caused to electrostatically adhere to the object 10 to be coated, and thus the surface to be coated thereof may have at least conductivity. Here, conductivity means a volume resistivity of equal to or less than $10^{13}$ Ωcm. In addition, since the powder coating material 11 is caused to electrostatically adhere to the object 10 to be coated, a voltage may be applied to the object 10 to be coated such that the polarity of the object 10 to be coated or the surface to be coated thereof is opposite to the polarity of the charged powder coating material 11, or the object 10 to be coated may be grounded (earthed).

In addition, in this exemplary embodiment, a conductive steel sheet is applied as the object 10 to be coated, and a form in which the conductive steel sheet is grounded is illustrated.

(Transport Device)

The transport device 20 includes, for example, a pair of feed rolls 21 and a roll driving portion (for example, motor) (not illustrated). A single pair or plural pairs of feed rolls 21 are provided. The transport device 20 may include a transport belt in addition to the pair of feed rolls 21 or instead of the pair of feed rolls 21.

(Applying Unit)

Figure 2:
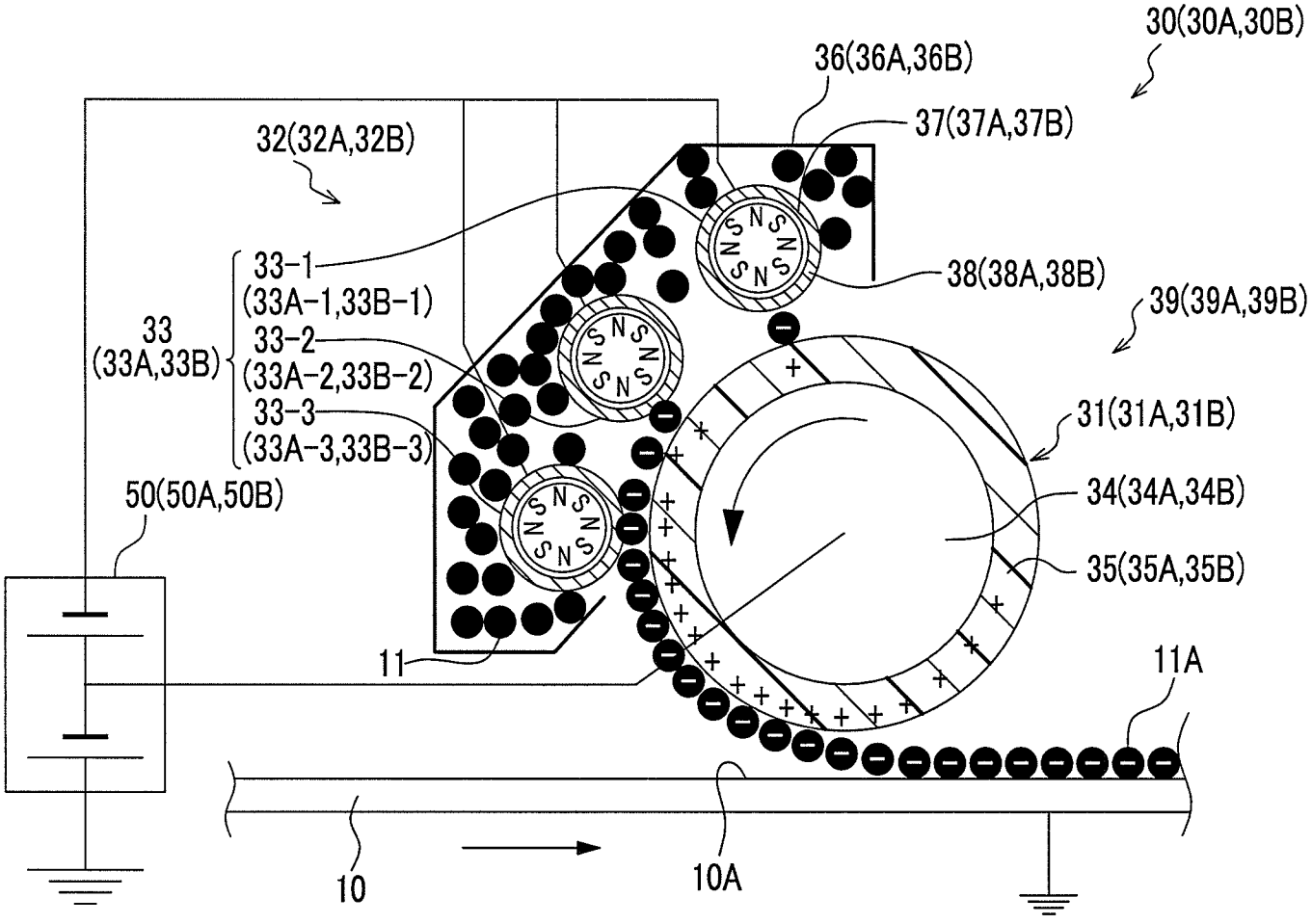
FIG. 2 is an enlarged schematic view illustrating the vicinity of an applying unit of the powder coating apparatus according to the exemplary embodiment.

As illustrated in FIGS. 1 and 2, the applying unit 30 is constituted by a first applying unit 30A and a second applying unit 30B which is disposed closer to the downstream side in a transport direction of the object 10 to be coated than the first applying unit 30A. The applying unit 30 may be constituted by a single applying unit 30 or may also be constituted by plural applying units, for example, three or more applying units 30.

In the applying unit 30, the first applying unit 30A and the second applying unit 30B are applying units which apply powder coating materials 11 with different colors onto the surface 10A to be coated of the object 10 to be coated.

Here, in a case where the applying unit 30 is constituted by the plural applying units, for example, three or more applying units, at least one applying unit 30 among the plural applying units may be an applying unit which applies a powder coating material 11 having a different color from those of the other applying units 30 onto the surface 10A to be coated of the object 10 to be coated. The color of the powder coating material 11 is selected depending on the color of a coating film 12 to be formed. In addition, the plural applying units may also be applying units 30 which apply powder coating materials 11 having the same color onto the surface 10A to be coated of the object 10 to be coated.

The first and second applying units 30A and 30B respectively rotate in the same direction as the transport direction of the object 10 to be coated and include applying sections 39A and 39B having cylindrical or columnar applying rolls 31A and 31B (an example of an applying member) which cause the powder coating material 11 that adhere to the surfaces thereof to be transferred and applied onto the surface 10A to be coated of the object 10 to be coated by a potential difference between the applying rolls 31A and 31B and the surface 10A to be coated of the object 10 to be coated, and supplying sections 32A and 32B having cylindrical or columnar supplying rolls 33A and 33B (an example of a supplying member) which supply the powder coating material 11 onto the surfaces of the applying rolls 31A and 31B.

Although not illustrated, the first and second applying units 30A and 30B may respectively have, for example, driving portions (for example, motors) which drive the applying rolls 31A and 31B to rotate and driving portions (for example, motors) which drive the supplying rolls 33.

The applying rolls 31A and 31B are respectively constituted by, for example, cylindrical or columnar conductive rolls 34A and 34B, and resistive layers 35A and 35B provided on the outer circumferential surfaces of the conductive rolls 34A and 34B. In addition, instead of the applying rolls 31A and 31B, an applying belt may also be applied as the applying member.

Each of the conductive rolls 34A and 34B may be configured as, for example, a metallic member including a metal (aluminum, copper, zinc, chromium, nickel, molybdenum, vanadium, indium, gold, platinum, or the like) or an alloy (stainless steel, an aluminum alloy, or the like). Otherwise, each of the conductive rolls 34A and 34B may also be configured as, for example, a resin member provided with a metal layer or an alloy layer on its outer circumferential surface.

Each of the resistive layers 35A and 35B contains, for example, a rubber or a resin, and a conducting material. Examples of the rubber include well-known rubbers such as isoprene rubber, chloroprene rubber, and epichlorohydrin rubber. Examples of the resin include well-known resins such as polyamide resin, polyester resin, and polyimide resin. Examples of the conducting material include well-known conductive materials including: carbon blacks such as ketjen black and acetylene black; metals or alloys such as aluminum and copper; and metal oxides such as tin oxide and indium oxide.

In addition, the volume resistivity of each of the resistive layers 35A and 35B is, for example, from $10^5$ Ωcm to $10^{10}$ Ωcm, and preferably from $10^6$ Ωcm to $10^8$ Ωcm.

The thickness of the resistive layers 35A and 35B is, for example, from 20 μm to 100,000 μm.

The supplying sections 32A and 32B respectively include, for example, housings 36A and 36B having openings on the sides that oppose the applying rolls 31A and 31B, and the supplying rolls 33A and 33B which are provided to oppose the applying rolls 31A and 31B at the openings of the housings 36A and 36B.

The supplying rolls 33A and 33B are configured as roll members respectively including, for example, cylindrical or columnar magnet rolls 37A and 37B in which the magnetic poles are alternately switched, and conductive sleeves 38A and 38B which are concentrically disposed on the outsides of the magnet rolls 37A and 37B.

The supplying rolls 33A and 33B are respectively constituted by first supplying rolls 33A-1 and 33B-1, second supplying rolls 33A-2 and 33B-2, and third supplying rolls 33A-3 and 33B-3. The first supplying rolls 33A-1 and 33B-1, the second supplying rolls 33A-2 and 33B-2, and the third supplying rolls 33A-3 and 33B-3 are arranged in this order from the upstream side to the downstream side in the rotation direction of the applying rolls 31A and 31B.

The supplying roll 33A or 333 may be configured as a single supplying roll 33A or 33B, two supplying rolls 33A or 33B, or plural supplying rolls, for example, four or more supplying rolls 33A or 33B.

Each of the supplying sections 32A and 32B (the insides of the housings 36A and 36B) accommodates, for example, the powder coating material 11 and a magnetic carrier (not illustrated) for charging the powder coating material 11. In the housings 36A and 36B of the supplying sections 32A and 32B, agitation members (for example, augers) (not illustrated) are provided. In addition, when the powder coating material 11 and the magnetic carrier are agitated by the agitation member, the powder coating material 11 is charged. In this exemplary embodiment, an example of negatively charging the powder coating material 11 is illustrated.

Here, in order to charge the powder coating material 11, as the magnetic carrier, for example, magnetic material particles such as ferrite particles or magnetic material particles having a resin coating layer on the surface are applied.

Hereinafter, in the description of the first and second applying units 30A and 30B and the constituent members thereof, for example, denotement is made as the applying unit 30 and the like, and there may be cases where "A" and "B" in reference numerals are omitted.

(Heating Device)

The heating device 40 is constituted by, for example, a first heating device 40A which heats the powder particle layer 11A applied onto the surface 10A to be coated of the object 10 to be coated by the first applying unit 30A so as to be thermally cured, and a second heating device 40B which heats the powder particle layer 11A applied onto the surface 10A to be coated of the object 10 to be coated by the second applying unit 30B so as to be thermally cured.

The heating device 40 may also be constituted by a single heating device, or plural heating devices, for example, three or more heating devices 40 depending on the number of applying units 30. The plural heating devices 40 respectively heat the powder particle layers 11A applied onto the surface 10A to be coated of the object 10 to be coated by the plural applying units 30 so as to be thermally cured.

However, even in a case where the plural applying units 30 are provided, the heating device 40 may also be configured as a single heating device 40. In this case, the single heating device 40 is provided closer to the downstream side in the transport direction of the object 10 to be coated than the applying unit 30 provided closest to the downstream side in the transport direction of the object 10 to be coated among the plural applying units 30. In addition, the single heating device 40 collectively heats all the powder particle layers 11A applied onto the surface 10A to be coated of the object 10 to be coated by the plural applying units 30 so as to be thermally cured.

Furthermore, units each of which including the plural applying units 30 and the single heating device 40 may further be arranged in the transport direction of the object 10 to be coated.

Each of the first and second heating devices 40A and 40B includes, for example, a heat source although not illustrated. The heat source is disposed to oppose the powder particle layer 11A formed on the surface 10A to be coated of the transported object 10 to be coated. Examples of the heat source include a halogen lamp, a ceramic heater, and an infrared lamp.

The first and second heating devices 40A and 40B may be laser irradiating devices which emit infrared lasers to heat the powder particle layer 11A.

Hereinafter, in the description of the first and second heating devices 40A and 40B, for example, denotement is made as the heating device 40 and the like, and there may be cases where "A" and "B" in reference numerals are omitted.

(Voltage Applying Device)

The voltage applying device 50 is constituted by a first voltage applying device 50A which is electrically connected to the applying roll 31A (the conductive roll 34A thereof) of the first applying unit 30A and the supplying roll 33A (the conductive sleeve 38A thereof), and a second voltage applying device 50B which is electrically connected to the applying roll 31B (the conductive roll 34B thereof) of the second applying unit 30B and the supplying roll 33B (the conductive sleeve 38B thereof).

The voltage applying device 50 may also be constituted by a single, or plural voltage applying devices, for example, three or more voltage applying devices 50 depending on the number of applying units 30.

Each of the first and second voltage applying devices 50A and 50B is configured as, for example, various types of power sources. In addition, in the first and second voltage applying devices 50A and 50B, for example, terminals having one polarity are electrically connected to the applying rolls 31A and 31B (the conductive rolls 34A and 34B thereof) of the first and second applying units 30A and 30B and the supplying rolls 33A and 33B (the conductive sleeves 38A and 38B thereof), and terminals having the other polarity are grounded. In addition, the first and second voltage applying devices 50A and 50B are connected to the members to apply voltages so that, for example, the supplying rolls 33A and 33B (the conductive sleeves 38A and 38B thereof) have higher potentials (absolute values) than the applying rolls 31A and 31B (the conductive rolls 34A and 34B thereof).

Here, in this exemplary embodiment, a form in which a negative voltage is applied to the applying rolls 31A and 31B (the conductive rolls 34A and 34B thereof) and the supplying rolls 33A and 33B (the conductive sleeves 38A and 38B thereof) by the first and second voltage applying devices 50A and 50B is illustrated.

Hereinafter, in the description of the first and second voltage applying devices 50A and 50B, for example, denotement is made as the voltage applying device 50 and the like, and there may be cases where "A" and "B" in reference numerals are omitted.

(Control Device)

Figure 3:
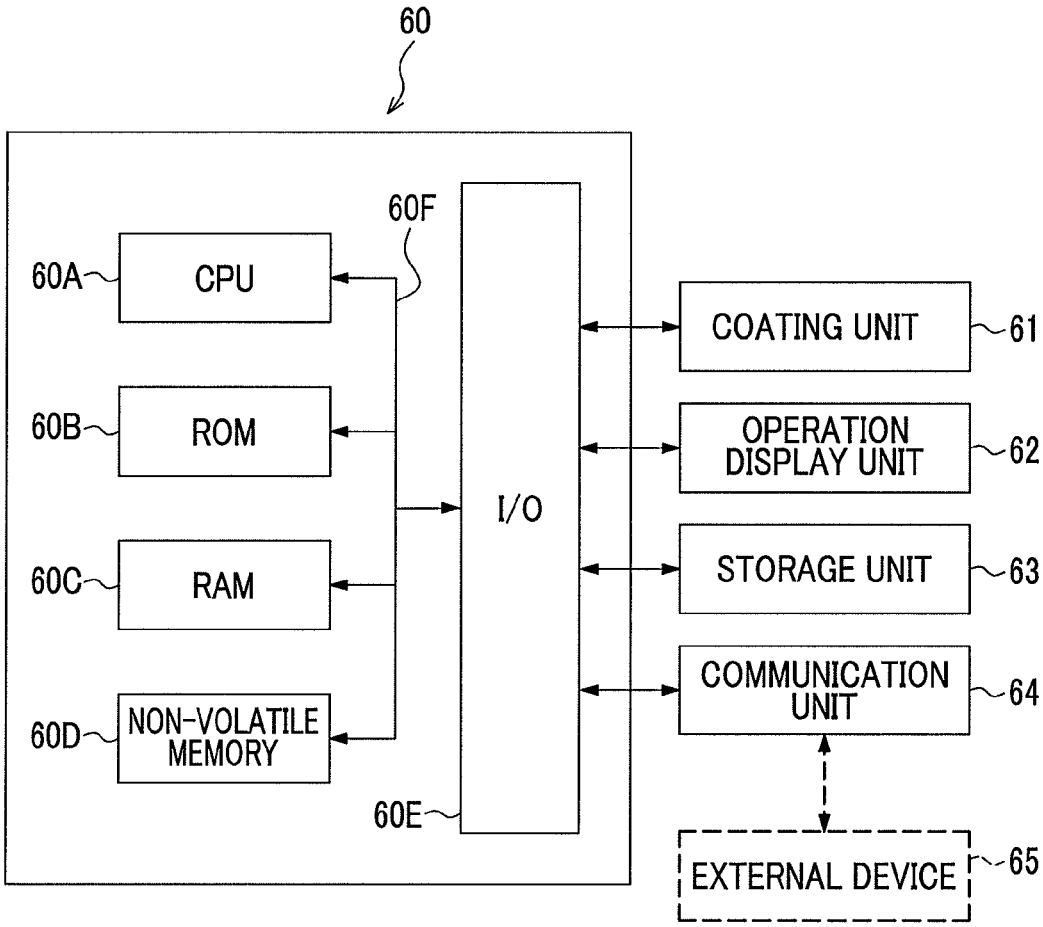
FIG. 3 is a block diagram illustrating an example of the configuration of a control system of the powder coating apparatus according to the exemplary embodiment.

The control device 60 is configured as a computer which controls the entire apparatus and performs various operations. Specifically, as illustrated in FIG. 3, the control device 60 includes, for example, a central processing unit (CPU) 60A, a read only memory (ROM) 60B which stores various programs, a random access memory (RAM) 60C which is used as a work area during execution of the programs, a non-volatile memory 60D which stores various types of information, and an input/output interface (I/O) 60E. The CPU 60A, the ROM 60B, the RAM 60C, the non-volatile memory 60D, and the I/O 60E are connected to each other via a bus 60F.

In addition, each of a coating unit 61, an operation display unit 62, a storage unit 63, and a communication unit 64 is connected to the I/O 60E of the control device 60. The control device 60 transmits and receives information to and from each of the operation display unit 62, the storage unit 63, and the communication unit 64 to control each of the units.

The coating unit 61 is mentioned as a main component of the powder coating apparatus 101. That is, the coating unit 61 is connected to each of the other devices (not illustrated) needed for powder coating such as the transport device 20, each member of the applying unit 30 (or the driving portion thereof), and the heating device 40. The control device 60 transmits and receives information to and from each of the devices to control each of the devices.

The operation display unit 62 includes, for example, various buttons such as a start button and a numeric keypad, a touch panel for displaying various screens such as a warning screen and a setting screen, and the like. The operation display unit 62 receives an operation from a user and displays various types of information for the user with the above-described configuration.

The storage unit 63 includes, for example, a storage device such as a hard disk. The storage unit 63 stores, for example, various types of data such as log data and various programs.

The communication unit 64 is, for example, an interface for communication with an external device 65 via a wired or wireless communication line. For example, the communication unit 64 acquires coating instructions or coating information from the external device 65.

In addition, for example, various types of drives may also be connected to the control device 60. Various types of devices are, for example, devices that read data from a computer-readable portable recording medium such as a flexible disk, a magneto-optical disc, a CD-ROM, a DVD-ROM, or a USB memory or write data on the recording medium. In a case where the various types of devices are included, control programs may be recorded on the portable recording medium and may be read by corresponding devices to be executed.

(Operation of Powder Coating Apparatus)

Next, an example of the operation of the powder coating apparatus 101 according to this exemplary embodiment will be described. In addition, the operation of the powder coating apparatus 101 is performed according to the various programs executed by the control device 60.

When the powder coating apparatus 101 receives a coating instruction or the like from the external device 65, for example, via the operation display unit 62 or the communication unit 64, the powder coating apparatus 101 acquires coating information received along with the coating instruction. The acquired coating information is stored in, for example, the RAM 60C.

Next, the object 10 to be coated is transported by the transport device 20 according to the acquired coating information. Specifically, for example, in the transport device 20, the pair of feed rolls 21 are driven by the driving portion (not illustrated) to transport the object 10 to be coated.

Next, for example, the charged powder coating material 11 is applied onto the surface 10A to be coated of the object 10 to be coated by each of the first and second applying units 30A and 30B. That is, after the charged powder coating material 11 is applied onto the surface 10A to be coated of the object 10 to be coated by the first applying unit 30A, in order to overlap the powder particle layer 11A of this powder coating material 11, the charged powder coating material 11 is further applied by the second applying unit 30B onto the powder particle layer 11A of the powder coating material 11 formed by the first applying unit 30A. Here, in this exemplary embodiment, the charged powder coating material 11 is applied by the second applying unit 30B onto the powder particle layer 11A after being cured.

Specifically, for example, a voltage (negative voltage) is applied to the applying rolls 31A and 31B (the conductive rolls 34A and 34B thereof) of the first and second applying units 30A and 30B and the supplying rolls 33A and 33B (the conductive sleeves 38A and 38B thereof) by the first and second voltage applying devices 50A and 50B. In this state, in the first and second applying units 30A and 30B, the supplying rolls 33A and 33B are driven by the driving portions (not illustrated) to rotate in the same direction as the transport direction of the object 10 to be coated. In addition, the supplying rolls 33A and 33B are driven by the driving portions (not illustrated) to rotate in the same direction as the rotation direction of the applying rolls 31A and 31B. Otherwise, the supplying rolls 33A and 33B may also be driven to rotate in the opposite direction to the rotation direction of the applying rolls 31A and 31B.

At this time, by the voltage applied to the conductive sleeves 38A and 38B on the surface of the supplying rolls 33A and 33B and the magnetic force of the magnet rolls 37A and 37B in the supplying rolls 33A and 33B, plural magnetic carriers are held in rows in a bristled form on the surfaces of the supplying rolls 33A and 33B. In addition, the powder coating material 11 which is, for example, negatively charged, adheres to the surface of the magnetic carriers. In this state, the plural magnetic carriers held in rows in a bristled form are moved to positions that oppose the conductive rolls 34A and 34B of the applying rolls 31A and 31B by the rotation of the supplying rolls 33A and 33B. Since a voltage (negative voltage) having a lower potential than that of the supplying rolls 33A and 33B is applied to each of the conductive rolls 34A and 34B of the applying rolls 31A and 31B, each of the outer circumferential surfaces of the resistive layers 35A and 35B provided on the outer circumferential surfaces of the conductive rolls 34A and 34B has a potential that is more positive than that of the supplying rolls 33A and 33B. Therefore, when the magnetic carriers are moved to the positions that oppose the surfaces of the conductive rolls 34A and 34B of the applying rolls 31A and 31B, the powder coating material 11 that adheres to the surfaces of the plural magnetic carriers held in rows in a bristled form is transferred to the surfaces of the conductive rolls 34A and 34B (the applying rolls 31A and 31B).

In addition, the supply of the powder coating material 11 to the applying roll 31 from the supplying roll 33 is performed over the entire surface from one end to the other end of the applying roll 31 in the axial direction.

On the other hand, the object 10 to be coated is grounded. Therefore, the powder coating material 11 that adheres to the surface of each of the supplying rolls 33A and 33B is transferred onto the surface 10A to be coated of the object 10 to be coated by a potential difference between the supplying rolls 33A and 33B and the surface 10A to be coated of the object 10 to be coated. Accordingly, the powder coating material 11 that adheres to the surface of each of the supplying rolls 33A and 33B is applied onto the surface 10A to be coated of the object 10 to be coated.

Depending on the acquired coating information, there may be cases where the charged powder coating material 11 is applied onto the surface 10A to be coated of the object 10 to be coated only by the first applying unit 30A.

Next, the powder particle layer 11A applied by the first applying unit 30A onto the surface 10A to be coated of the object 10 to be coated is heated by the first heating device 40A so as to be thermally cured. In addition, the powder particle layer 11A applied by the second applying unit 30B onto the surface 10A to be coated of the object 10 to be coated is heated by the second heating device 40B so as to be thermally cured.

In addition, when the thermosetting resin of the powder particles is a curable polyester resin, the heating temperature (baking temperature) of the powder particle layer 11A is preferably from 90° C. to 250° C., more preferably from 100° C. to 220° C., and even more preferably from 120° C. to 200° C. Such a temperature range of the heating temperature (baking temperature) varies depending on the curing temperature properties of the thermosetting resin.

In the above-described process, the powder coating material 11 is coated by forming the coating film 12 on the coating surface of the object 10 to be coated.

Here, the thickness of the coating film 12 to be formed is adjusted by the thickness of the powder particle layer 11A. In addition, the thickness of the powder particle layer 11A is adjusted by the amount of powder coating material 11 applied by the applying unit 30. However, the transfer of the powder coating material 11 from the applying roll 31 of the applying unit 30 to the surface 10A to be coated of the object 10 to be coated is performed during discharge by providing a potential difference. When the potential difference is increased to increase the application amount of the powder coating material 11, the powder particle layer 11A may scatter due to the discharge. Therefore, a situation in which it is difficult to form the coating film 12 having a desired thickness by adjusting the thickness of the powder particle layer 11A through the adjustment of the potential difference occurs.

Here, in the powder coating apparatus 101 according to this exemplary embodiment, the speed ratio between the transport speed of the object 10 to be coated and the rotation speed of the applying roll 31 (hereinafter, also simply referred to as "speed ratio") is controlled by the control device 60 so that the thickness of the powder particle layer 11A applied by the applying unit 30 onto the surface 10A to be coated of the object 10 to be coated becomes a predetermined thickness. That is, the transport device 20 (the driving portion thereof) and the applying roll 31 (the driving portion thereof) are controlled by the control device 60 to achieve a speed ratio at which the thickness of the powder particle layer 11A becomes a predetermined thickness.

This is specifically described as follows.

Figure 4:
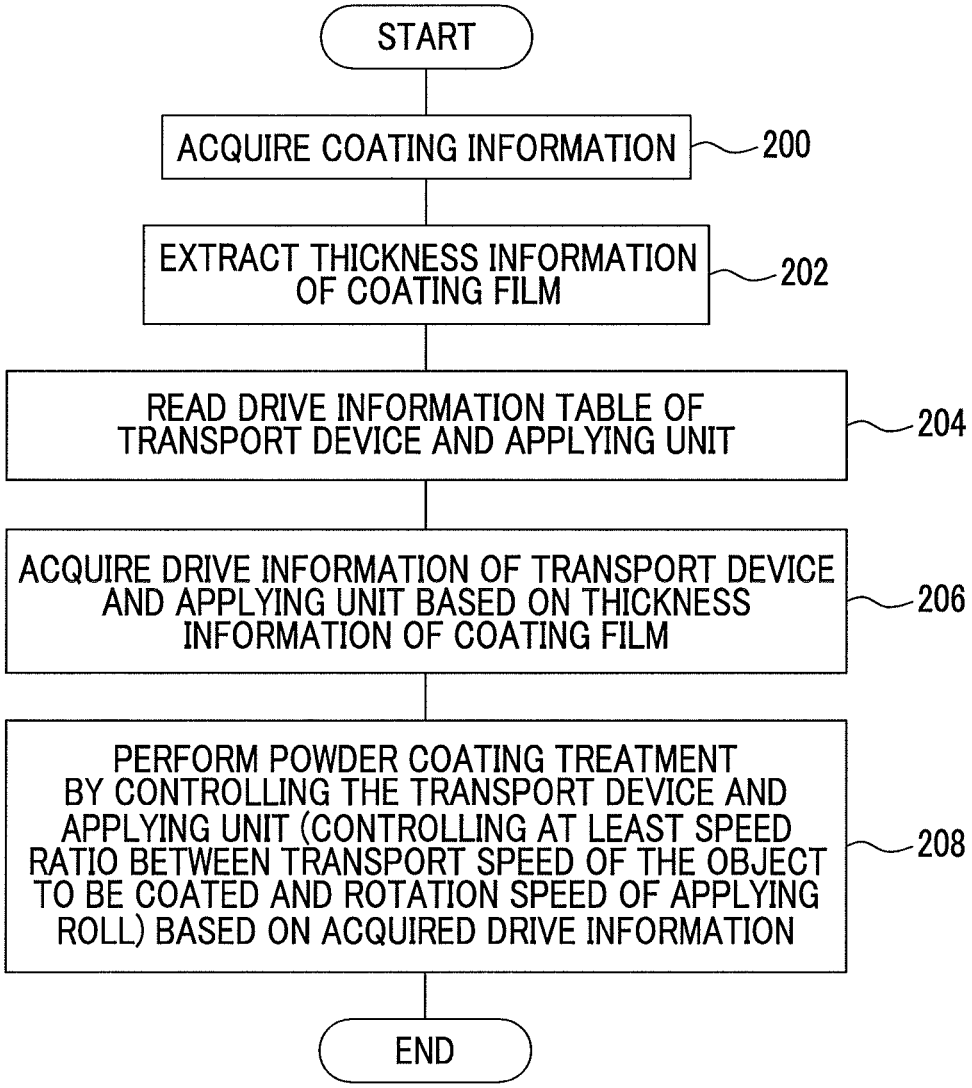
FIG. 4 is a flowchart illustrating an example of a process executed by a control device of the powder coating apparatus according to the exemplary embodiment.

FIG. 4 is a flowchart illustrating a process executed by the control device 60 of the powder coating apparatus 101 of this exemplary embodiment. The process executed by the control device 60 of the powder coating apparatus 101 of this exemplary embodiment is a process of controlling the thickness of the powder particle layer 11A.

Here, a control program of "a process of controlling the thickness of the powder particle layer 11A" is, for example, read from the ROM 60B and executed by the CPU 60A. The control program of "a process of controlling the thickness of the powder particle layer 11A" is started, for example, when a coating instruction or the like is received from the operation display unit 62 or the external device 65 via the communication unit 64. In addition, information acquired during the process is stored in, for example, the RAM 60C which is the work area so as to be used. However, this is only an example, and the process is not limited thereto.

As illustrated in FIG. 4, first, in Step 200, coating information including the thickness information and the like of the coating film 12 to be formed is acquired.

Next, in Step 202, the thickness information of the coating film 12 is extracted from the coating information.

Next, in Step 204, a drive information table of the transport device 20 and the applying unit 30 is read based on the thickness information of the coating film 12, and the process proceeds to Step 206.

In addition, in Step 206, drive information of the transport device 20 and the applying unit 30 is acquired from the drive information table based on the thickness information of the coating film 12.

Here, the drive information table of the transport device 20 and the applying unit 30 (hereinafter, also referred to as "drive information table") is, for example, stored in advance in the ROM 60B, the non-volatile memory 60D, or the storage unit 63.

The drive information table is, for example, a table in which the thickness information of the coating film 12 is connected to the drive conditions of the transport device 20 and the applying unit 30. Specifically, the drive information table is, for example, a table in which the transport speed of the object 10 to be coated in the transport device 20, the rotation speed of the applying roll 31 in the applying unit 30, the number of times the supplying roll 33 is driven, the number of times the applying unit 30 is driven, and the voltage applied to the supplying roll 33 (the conductive roll 34 thereof) by the voltage applying device 50 are set according to the thickness of the coating film 12. That is, the drive information table is a table in which the speed ratio between the transport speed of the object 10 to be coated and the rotation speed of the applying roll 31, the number of times the supplying roll 33 is driven, the number of times the applying unit 30 is driven, and the potential difference between the supplying roll 33 and the surface 10A to be coated of the object 10 to be coated are set according to the thickness of the coating film 12.

The drive information table is created, for example, based on an examination in which the speed ratio between the transport speed of the object 10 to be coated and the rotation speed of the applying roll 31, the number of times the supplying roll 33 is driven, the number of times the applying unit 30 is driven, and the potential difference between the supplying roll 33 and the surface 10A to be coated of the object 10 to be coated are changed in advance according to the thickness of the coating film 12 to be formed, and the thickness of the coating film 12 (that is, the thickness of the powder particle layer 11A) formed according to the changes is examined.

In addition, the drive information table is a table in which the speed ratio between the transport speed of the object 10 to be coated and the rotation speed of the applying roll 31 is set according to the thickness of the coating film 12, and may also be a table in which conditions other than the above conditions are not changed. Furthermore, the drive information table is a table in which at least one of the speed ratio between the transport speed of the object 10 to be coated and the rotation speed of the applying roll 31; the number of times the supplying roll 33 is driven, and the number of times the applying unit 30 is driven are set according to the thickness of the coating film 12 to be formed, and may also be a table in which conditions other than the above conditions are not changed.

Based on the drive information table created as above, at least the speed ratio between the transport speed of the object 10 to be coated and the rotation speed of the applying roll 31 is set. In addition, the number of times the supplying roll 33 is driven, the number of times the applying unit 30 is driven, and the potential difference between the supplying roll 33 and the surface 10A to be coated of the object 10 to be coated are also set.

Next, in Step 208, a powder coating treatment is performed by controlling the transport device 20 and the applying unit 30 (that is, controlling at least the speed ratio between the transport speed of the object 10 to be coated and the rotation speed of the applying roll 31) based on the acquired drive information of the transport device 20 and the applying unit 30, and then the routine is ended.

Here, the "powder coating treatment" is a powder coating sequence of performing an application process of applying the powder coating material 11 onto the surface 10A to be coated of the object 10 to be coated by the applying unit 30 and a heating process of heating the powder particle layer 11A applied onto the surface 10A to be coated of the object 10 to be coated so as to be thermally cured.

In addition, the powder coating sequence is performed by controlling the speed ratio between the transport speed of the object 10 to be coated and the rotation speed of the applying roll 31 so that the thickness of the powder particle layer 11A applied by the applying unit 30 onto the surface 10A to be coated of the object 10 to be coated becomes a predetermined thickness.

In this exemplary embodiment, the powder coating sequence is also performed by controlling the number of times the supplying roll 33 is driven, the number of times the applying unit 30 is driven, and the potential difference between the supplying roll 33 and the surface 10A to be coated of the object 10 to be coated.

In the powder coating apparatus 101 according to this exemplary embodiment described above, the speed ratio between the transport speed of the object 10 to be coated and the rotation speed of the applying roll 31 (hereinafter, also simply referred to as "speed ratio") is controlled by the control device 60 so that the thickness of the powder particle layer 11A applied by the applying unit 30 onto the surface 10A to be coated of the object 10 to be coated becomes a predetermined thickness. That is, the transport device 20 (the driving portion thereof) and the applying roll 31 (the driving portion thereof) are controlled by the control device 60 to achieve a speed ratio at which the thickness of the powder particle layer 11A becomes a predetermined thickness.

Figure 5:
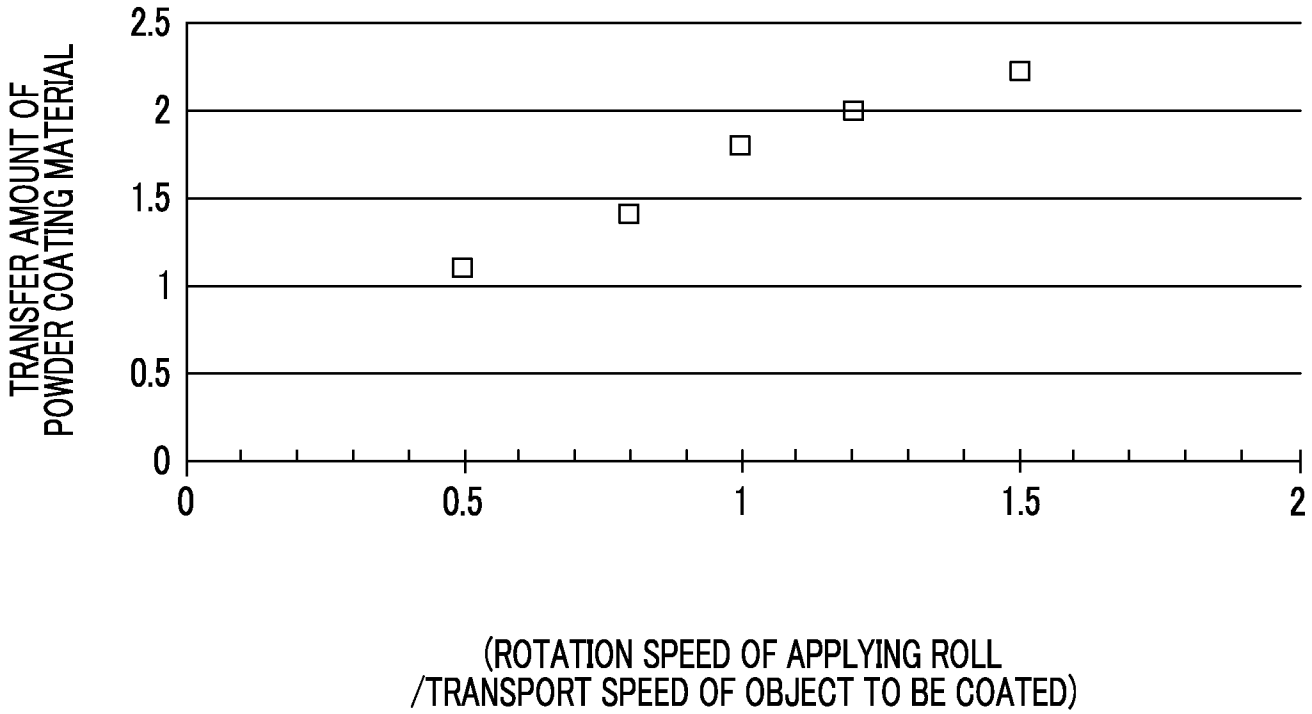
FIG. 5 is a view illustrating the relationship between the speed ratio between the transport speed of an object to be coated and the rotation speed of an applying roll (the rotation speed of the applying roll/the transport speed of the object to be coated) and the transfer amount of a powder coating material transferred from the applying roll to the surface to be coated of the object to be coated.

Here, FIG. 5 illustrates the relationship between the speed ratio between the transport speed of the object 10 to be coated and the rotation speed of the applying roll 31 (the rotation speed of the applying roll 31/the transport speed of the object 10 to be coated) and the transfer amount of the powder coating material 11 transferred from the applying roll 31 to the surface 10A to be coated of the object 10 to be coated. The relationship is a relationship indicating how much the thickness of the powder particle layer 11A is transferred to the surface 10A to be coated of the object 10 to be coated according to the speed ratio in a state where the powder particle layer 11A having a thickness of three particles is adhered to the surface of the applying roll 31. That is, a number in the vertical axis of the graph shown in FIG. 5 represents how many the particles of the thickness of the powder particle layer 11A are transferred to the surface 10A to be coated of the object 10 to be coated.

As illustrated in FIG. 5, it may be seen that, based on the speed ratio between the transport speed of the object 10 to be coated and the rotation speed of the applying roll 31 (the rotation speed of the applying roll 31/the transport speed of the object 10 to be coated) as 1, when the speed ratio increases (that is, when the transport speed of the object 10 to be coated is slower than the rotation speed of the applying roll 31), the transfer amount of the powder coating material 11 transferred from the applying roll 31 to the surface 10A to be coated of the object 10 to be coated is increased. On the other hand, it may be seen that, when the speed ratio decreases (that is, when the transport speed of the object 10 to be coated is faster than the rotation speed of the applying roll 31), the transfer amount of the powder coating material 11 transferred from the applying roll 31 to the surface 10A to be coated of the object 10 to be coated is decreased.

In addition, the speed ratio between the transport speed of the object 10 to be coated and the rotation speed of the applying roll 31 (the rotation speed of the applying roll 31/the transport speed of the object 10 to be coated) is the speed ratio between the movement speed of the surface to be coated of the object 10 to be coated which opposes the surface of the applying roll 31 and the movement speed of the surface of the applying roll 31 which opposes the surface 10A to be coated of the object 10 to be coated.

As described above, in the powder coating apparatus 101, by controlling the speed ratio, the thickness of the powder particle layer 11A of the powder coating material 11 formed on the surface 10A to be coated of the object 10 to be coated is adjusted. That is, the thickness of the coating film 12 to be formed is adjusted. Therefore, in the powder coating apparatus 101, powder coating is obtained by forming the coating film 12 having a desired thickness with good productivity.

In addition, in the powder coating apparatus 101, since the thickness of the powder particle layer 11A is adjusted by the speed ratio, an increase in the thickness of the powder particle layer 11A is obtained even when the potential difference between the supplying roll 33 and the surface 10A to be coated of the object 10 to be coated is set to be low. When an electric field generated by the potential difference between the supplying roll 33 and the surface 10A to be coated of the object 10 to be coated exceeds a Paschen discharge field generated between the particles of the powder particle layer 11A transferred to the coating surface of the object 10 to be coated, ionization occurs due to the Paschen discharge field. At this time, an impact and an uneven density in charges occur, and thus the thickness of the powder particle layer 11A may become uneven. Contrary to this, in the powder coating apparatus 101, since the potential difference is able to be set to be low, unevenness in the thickness due to the Paschen discharge is prevented even when the thickness of the powder particle layer 11A (that is, the thickness of the coating film 12) increases.

In addition, in the powder coating apparatus 101, since the thickness of the powder particle layer 11A is adjusted by the speed ratio, controlling of the thickness of the coating film 12 is easily stabilized regardless of the resistance of the object 10 to be coated, the dielectric properties of the resistive layer of the applying roll 31, the potential difference between the applying roll 31 and the surface 10A to be coated of the object 10 to be coated, and the like.

In addition, in the powder coating apparatus 101, the supply of the powder coating material 11 to the applying roll 31 from the supplying roll 33 is performed over the entire surface from one end to the other end of the applying roll 31 in the axial direction. In addition, the powder coating material 11 which adheres to the surface of the applying roll 31 from one end to the other end in the axial direction is transferred and applied onto the surface 10A to be coated of the object 10 to be coated. Therefore, the powder coating material 11 is applied to the edge portions of the surface 10A to be coated of the object 10 to be coated in the width direction (edge portions of the object 10 to be coated in a direction intersecting the transport direction thereof). That is, coating of the entire region of the surface 10A to be coated of the object 10 to be coated with the powder coating material 11 is obtained.

In addition, in the powder coating apparatus 101, since the supply of the powder coating material 11 to the applying roll 31 from the supplying roll 33 is performed over the entire surface from one end to the other end of the applying roll 31 in the axial direction, a reduction in the charging amount of the powder coating material 11 is obtained.

Figure 6:
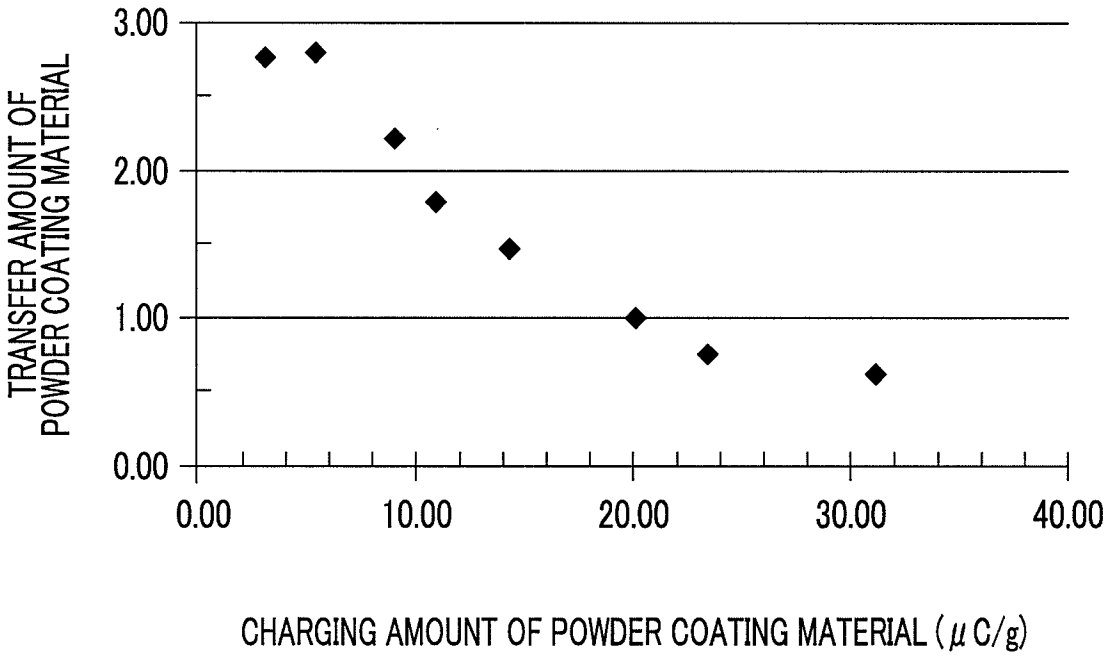
FIG. 6 is a view illustrating the relationship between the charging amount of the powder coating material and the transfer amount of the powder coating material 11 transferred from the applying roll to the surface to be coated of the object to be coated.

Here, FIG. 6 illustrates the relationship between the charging amount of the powder coating material 11 and the transfer amount of the powder coating material 11 transferred from the applying roll 31 to the surface 10A to be coated of the object 10 to be coated. The relationship is a relationship indicating how much the thickness of the powder particle layer 11A is transferred to the surface 10A to be coated of the object 10 to be coated according to the charging amount of the powder coating material 11 in a state where the powder particle layer 11A having a thickness of three particles is adhered to the surface of the applying roll 31. That is, a number in the vertical axis of the graph shown in FIG. 6 represents how many the particles of the thickness of the powder particle layer 11A are transferred to the surface 10A to be coated of the object 10 to be coated.

As illustrated in FIG. 6, it may be seen that, when the charging amount of the powder coating material 11 is low, the transfer amount of the powder coating material 11 transferred from the applying roll 31 to the surface 10A to be coated of the object 10 to be coated is increased.

As described above, in the powder coating apparatus 101, an increase in the transfer amount of the powder coating material 11 transferred from the applying roll 31 to the surface 10A to be coated of the object 10 to be coated is obtained by increasing or decreasing the charging amount of the powder coating material 11. Therefore, in the powder coating apparatus 101, powder coating is obtained by forming the coating film 12 having a desired thickness with good productivity.

In the powder coating apparatus 101 according to this exemplary embodiment, the supplying sections 32 of the applying unit 30 includes, as the supplying roll, plural supplying rolls 33 (in this exemplary embodiment, the three supplying rolls 33 including the first supplying roll 33, the second supplying roll 33, and the third supplying roll 33) arranged along the circumferential direction of the applying roll 31.

Figure 7:
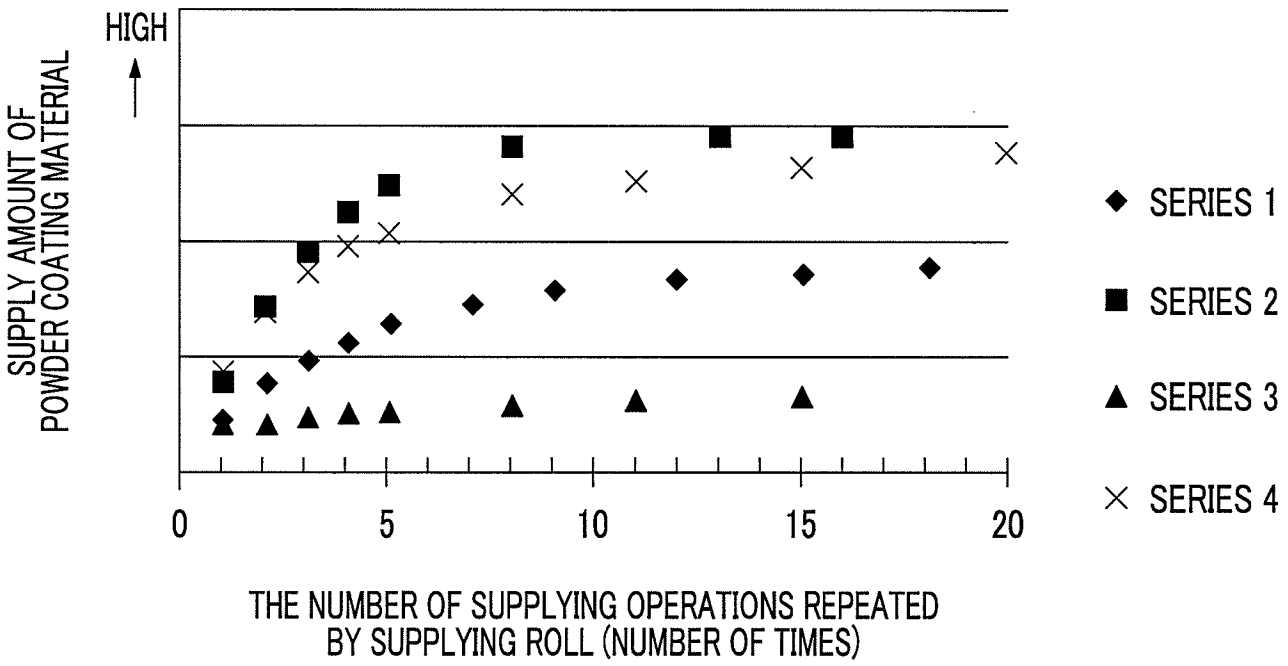
FIG. 7 is a view illustrating the relationship between the number of supplying operations repeated by a single supplying roll and the supply amount of the powder coating material supplied from a supplying roll to the applying roll.

Here, FIG. 7 illustrates the relationship between the number of supplying operations repeated by the single supplying roll 33 and the supply amount of the powder coating material 11 supplied from the supplying roll 33 to the applying roll 31. The relationship is a relationship indicating how much the supply amount of the powder coating material supplied to the applying roll 31 is increased by the number of repeated supplies which is counted assuming that the number of supplying operations by the supplying roll 33 is one when the applying roll 31 rotates once. In addition, FIG. 7 illustrates the relationship measured in Series 1 to Series 4 in which the potential difference between the supplying roll 33 and the applying roll 31, the rotation directions of the supplying roll 33 and the applying roll 31, the ratio between the rotation speeds of the supplying roll 33 and the applying roll 31, and the like are changed.

As illustrated in FIG. 7, it may be seen that, in any of the Series, the supply amount of the powder coating material supplied to the applying roll 31 is increased by repeatedly supplying the powder coating material by the single supplying roll 33. However, it may be seen that the rate of increase in the supply amount of the powder coating material decreases and is saturated when the number of repeated supplies is 5. That is, it may be seen that an increase in the supply amount of the powder coating material 11 supplied from the supplying roll 33 to the applying roll 31 is obtained by increasing the number of supplying rolls 33.

As described above, in the powder coating apparatus 101, by providing the plural supplying rolls 33, the supply amount of the powder coating material 11 supplied from the supplying roll 33 to the applying roll 31 is increased. Therefore, the range of adjustment of the thickness of the powder particle layer 11A with the speed ratio is increased, and thus the degree of freedom of the thickness of the coating film 12 to be formed is increased.

In addition, as illustrated in FIG. 7, the number of supplying rolls 33 is preferably from 2 to 5 in terms of an increase in the supply amount of the powder coating material 11, and is more preferably from 2 to 3 in terms of an increase in the supply amount of the powder coating material 11 and a reduction in the size of the apparatus.

Furthermore, by controlling the number of supplying rolls 33 to be driven among the plural supplying rolls 33 by the control device 60, the adjustment of the amount of the powder coating material 11 that adhere to the applying roll 31 itself is obtained, and thus the degree of freedom of the thickness of the coating film 12 to be formed is increased.

In the powder coating apparatus 101 according to this exemplary embodiment, as the applying unit 30, the plural applying units 30 (in this exemplary embodiment, the two applying units 30 including the first applying unit 30 and the second applying unit 30) arranged in the transport direction of the object 10 to be coated are included. By forming the powder particle layers 11A to be overlapped by the plural applying units 30, the thickness of the powder particle layers 11A that may be formed on the coating surface of the object 10 to be coated is increased. Therefore, the degree of freedom of the thickness of the coating film 12 to be formed is increased.

In addition, by controlling the number of applying units 30 to be driven among the plural applying units 30 by the control device 60, the degree of freedom of the thickness of the coating film 12 to be formed is increased.

Here, as described above, when the charging amount of the powder coating material 11 is low, the transfer amount of the powder coating material 11 transferred from the applying roll 31 to the surface 10A to be coated of the object 10 to be coated is increased (see FIG. 6). However, when the charging amount of the powder coating material 11 is excessively reduced, there is a tendency to increase the number of particles charged to have opposite polarities in the powder coating material 11, and thus it is difficult for the powder coating material 11 to be transferred onto the surface 10A to be coated of the object 10 to be coated from the applying roll 31, resulting in instability.

Contrary to this, even when the amount of the powder particle layer 11A that may be formed by the single applying unit 30 is reduced by increasing the charging amount of the powder coating material 11, by forming the powder particle layers 11A to be overlapped by the plural applying units 30, the thickness of the powder particle layers 11A that may be formed on the coating surface of the object 10 to be coated is obtained.

Therefore, in the powder coating apparatus 101, since the plural applying units 30 are provided, the range of the charging amount of the powder coating material 11 that may be applied is widened, and thus the degree of freedom of the apparatus is increased.

In the powder coating apparatus 101 according to this exemplary embodiment, when at least one applying unit 30 among the plural applying units 30 is an applying unit which applies the powder coating material 11 having a different color from those of the other applying units 30 onto the surface 10A to be coated of the object 10 to be coated, powder coating is obtained by forming the coating film 12 having a desired color.

In the powder coating apparatus 101 according to this exemplary embodiment, as the heating device 40, the plural the heating devices (in this exemplary embodiment, the two heating devices 40 including the first heating device 40 and the second heating device 40) which respectively heat the powder particle layers 11A applied by the plural applying units 30 onto the surface 10A to be coated of the object 10 to be coated so as to be thermally cured are included. When the powder particle layers 11A respectively formed by the plural applying units 30 are thermally cured, there is no need to consider the Paschen discharge in the powder particle layers 11A after the curing. Therefore, even when the number of applying units 30 is increased, an increase in the thickness of the coating film 12 to be formed is obtained while preventing the thickness unevenness due to the Paschen discharge. As a result, the degree of freedom of the thickness of the coating film 12 to be formed is increased.

Hereinafter, the thermosetting powder coating material 11 which is appropriately used in the powder coating apparatus 101 according to this exemplary embodiment will be described and is referred to as a powder coating material according to this exemplary embodiment by omitting the reference numeral thereof.

The powder coating material according to this exemplary embodiment includes powder particles having a core containing a thermosetting resin and a hardener and a resin coating portion which coats the surface of the core.

In addition, the volume particle size distribution index GSDv of the powder particles is equal to or less than 1.50 and the average circularity of the powder particles is equal to or higher than 0.96.

The powder coating material according to this exemplary embodiment may be any of a transparent powder coating material (clear coating material) that does not contain a colorant in the powder particles and a colored powder coating material which contains a colorant in the powder particles.

With the above configuration, even when the powder particles are reduced in diameter, the powder coating material according to this exemplary embodiment forms a coating film having high smoothness with a small amount of the material and has high storage properties. Although the reason is not clear, it is assumed that this is caused for the following reasons.

First, in recent years, during the coating of a powder coating material, forming a thin coating film with a small amount of powder coating material is required. For this, there is a need to reduce the diameter of the powder particles of the powder coating material. However, when the diameter of the powder particles is simply reduced by a kneading and pulverizing method or the like, fine powder is produced, and thus the particle size distribution widens, resulting in a state where coarse powder and fine powder are increased in amount. In addition, the powder particles may have irregular shapes.

As a result of the increase in the amount of coarse powder in the powder particles, uneven portions are formed on the surface of the coating film due to the coarse powder, and thus a coating film having a low smoothness is likely to be formed. When there is a large amount of fine powder in the powder particles, the fluidity of the powder particles is reduced, and aggregates of the powder particles are easily formed. Therefore, a coating film having a low smoothness is likely to be formed. When the powder particles have irregular shapes, the fluidity of the powder particles is reduced, and aggregates (blocking) of the powder particles are easily formed. Therefore, a coating film having a low smoothness is likely to be formed. Furthermore, when the powder particles have irregular shapes, voids are more likely to be provided between the powder particles during the adhesion of the powder particles to a surface to be coated. As a result, uneven portions are formed on the surface of the coating film after heating, and thus a coating film having a low smoothness is likely to be formed.

Here, the volume particle size distribution index GSDv of the powder particles is caused to be equal to or less than 1.50. That is, by narrowing the particle size distribution of the powder particles, a state in which the amounts of coarse powder and fine powder are small is achieved. Accordingly, even when the diameter of the powder particles is reduced, a reduction in the fluidity and the formation of aggregates (blocking) of the powder particles are prevented.

In addition, the average circularity of the powder particles is caused to be equal to or higher than 0.96 such that the shapes of the powder particles are similar to spherical shapes. That is, even when the diameter of the powder particles is reduced, a reduction in the fluidity is prevented. In addition, by reducing the contact area between the powder particles, a state in which voids between the powder particles are reduced in size is achieved during the adhesion of the powder particles to the surface to be coated.

On the other hand, when the diameter of the powder particles is reduced, the distance from the inside to the surface of the powder particle is reduced. Therefore, a phenomenon in which inclusions (the hardener, and additives added in addition to the hardener as necessary, such as the colorant, a leveling agent, and a flame retardant) in the powder particles precipitate (hereinafter, also called "bleed") may easily occur with time. When the bleed occurs, aggregates (blocking) of the powder particles are formed, resulting in the deterioration in storage efficiency.

Here, as the powder particles, particles are applied in which a particle containing the thermosetting resin and the hardener (that is, a particle that functions as the powder coating material) is the core and the resin coating portion is formed on the surface of the core. When the powder particles having the layer configuration are applied, the resin coating portion acts as a barrier and thus the bleed of inclusions contained in the core such as the hardener to the surface of the powder particles is prevented.

For the above reason, it is assumed that the powder coating material according to this exemplary embodiment forms a coating film having high smoothness with a small amount of the material and has high has high storage efficiency even when the powder particles are reduced in diameter.

In addition, since the coating film having high smoothness is formed with a small amount of the powder coating material even when the powder particles are reduced in diameter, the powder coating material according to this exemplary embodiment also enhances the glossiness of the obtained coating film.

Furthermore, since the powder coating material according to this exemplary embodiment has high storage properties, even when the powder coating material that does not adhere to the surface to be coated is reused after powder coating, similarly, the formation of a coating film having high smoothness with a small amount of the material is obtained. Therefore, the powder coating material according to this exemplary embodiment also has high durability. In addition, since the powder coating material according to this exemplary embodiment has high fluidity, transport efficiency and coating efficiency are high and coating workability is excellent.

Hereinafter, the details of the powder coating material according to this exemplary embodiment will be described.

The powder coating material according to this exemplary embodiment includes powder particles. The powder coating material may also include an external additive that adheres to the surface of the powder particles as necessary in terms of an increase in fluidity.

[Powder Particles]

The powder particles have the core and the resin coating portion that adheres to the surface of the core. That is, the powder particles have a core-shell structure.

(Properties of Powder Particles)

The volume particle size distribution index GSDv of the powder particles is equal to or less than 1.50, preferably equal to or less than 1.40 in terms of the smoothness of the coating film and the storage properties of the powder coating material, and even more preferably equal to or less than 1.30.

The volume-average particle size D50v of the powder particles is preferably from 1 μm to 25 μm in terms of the formation of a coating film having high smoothness with a small amount, more preferably from 2 μm to 20 μm, and even more preferably from 3 μm to 15 μm.

The average circularity of the powder particles is equal to or higher than 0.96, preferably equal to or higher than 0.97 in terms of the smoothness of the coating film and the storage properties of the powder coating material, and even more preferably equal to or higher than 0.98.

Here, the volume-average particle size D50v and the volume particle size distribution index GSDv of the powder particles are measured by using the Coulter Multisizer II (manufactured by Beckman Coulter, Inc.), and using the Isoton II (manufactured by Beckman Coulter, Inc.) as an electrolytic solution.

During the measurement, as a dispersant, an amount of from 0.5 mg to 50 mg of a measurement sample is added to 2 ml of a 5% aqueous solution of a surfactant (preferably sodium alkylbenzene sulfonate). This is added to an amount of from 100 ml to 150 ml of the electrolytic solution.

The electrolytic solution in which the sample is suspended is subjected to a dispersion treatment for 1 minute by an ultrasonic dispersing unit, and a particle size distribution of particles in a range of from 2 μm to 60 μm is measured by Coulter Multisizer II, using a 100-μm aperture as an aperture diameter. In addition, the number of sampled particles is 50,000.

A cumulative distribution of volumes is drawn based on the measured particle size distribution from a small diameter side in terms of discrete particle size ranges (channels). A particle size which achieves cumulative 16% is defined as a volume particle size D16v, a particle size which achieves cumulative 50% is defined as a volume-average particle size D50v, and a particle size which achieves cumulative 84% is defined as a volume particle size D84v.

In addition, the volume-average particle size distribution index (GSDv) is calculated as $(D84v/D16v)^{1/2}$.

The average circularity of the powder particles is measured by using a flow type particle image analyzer "FPIA-3000 (manufactured by Sysmex Corporation)". Specifically, an amount of from 0.1 ml to 0.5 ml of a surfactant (alkyl benzene sulfonate) as a dispersant is added to an amount of from 100 ml to 150 ml of water from which solid impurities are removed in advance, and an amount of from 0.1 g to 0.5 g of the measurement sample is further added thereto. A suspension in which the measurement sample is dispersed is subjected to the dispersion treatment for from 1 minute to 3 minutes by the ultrasonic dispersing unit so that the dispersion concentration is from 3000 pieces/μl to 10,000 pieces/μl. For the dispersion, the average circularity of the powder particles is measured by using the flow type particle image analyzer.

Here, the average circularity of the powder particles is a value is calculated by obtaining the circularity (Ci) of each of n particles measured among the powder particles and then solving the following equation. Here, in the following equation, Ci represents the circularity (=the perimeter of a circle equivalent to the projected particle area/the perimeter of a projected particle image), and fi represents the frequency of the powder particles.

$$\text{Average Circularity } (Ca) = \left(\sum_{i=1}^{n} (Ci \times fi)\right) \Big/ \sum_{i=1}^{n} (fi) \qquad \text{[Equation 1]}$$

(Core)

The core contains the thermosetting resin and the hardener. The core may also contain the other additives such as colorants as necessary.

—Curable Resin—

The thermosetting resin is a resin having a thermosetting reactive group. As the thermosetting resin, hitherto, various types of resins used as powder particles of a powder coating material may be employed.

The thermosetting resin may be a water-insoluble (hydrophobic) resin. When the water-insoluble (hydrophobic) resin is applied as the thermosetting resin, the environmental dependence of the charging properties of the powder coating material (powder particles) is reduced. In addition, in a case where the powder particles are produced by an aggregation and coalescence method, the thermosetting resin may be a water-insoluble (hydrophobic) resin in terms of the realization of emulsion dispersion in an aqueous medium. Water insolubility (hydrophobicity) means that the amount of a dissolved object material with respect to 100 parts by weight of water at 25° C. is less than 5 parts by weight.

Among the thermosetting resins, at least one type selected from the group consisting of a thermosetting (meth)acrylic resin and a thermosetting polyester resin is preferable.

Thermosetting (Meth)acrylic Resin

The thermosetting (meth)acrylic resin is a (meth)acrylic resin having a thermosetting reactive group. For the introduction of the thermosetting reactive group to the thermosetting (meth)acrylic resin, a vinyl monomer having a thermosetting reactive group may be used. The vinyl monomer having a thermosetting reactive group may be a (meth) acrylic monomer (a monomer having a (meth)acryloyl group) and may also be a vinyl monomer other than the (meth)acrylic monomer.

Here, examples of the thermosetting reactive group of the thermosetting (meth)acrylic resin include an epoxy group, a carboxyl group, a hydroxyl group, an amide group, an amino group, an acid anhydride group, and a (blocked) isocyanate group. Among these, as the thermosetting reactive group of the (meth)acrylic resin, at least one type selected from the group consisting of an epoxy group, a carboxyl group, and a hydroxyl group is preferable in terms of ease of the manufacture of the (meth)acrylic resin. Particularly, in terms of excellent storage stability of the powder coating material and the external form of the coating film, it is more preferable that at least one type of the curing reactive group is an epoxy group.

Examples of the vinyl monomer having an epoxy group as the thermosetting reactive group include various types of chain epoxy group-containing monomers (for example, glycidyl (meth)acrylate, β-methyl glycidyl (meth)acrylate, glycidyl vinyl ether, and allyl glycidyl ether), various types of (2-oxo-1,3-oxolane) group-containing vinyl monomers (for example, (2-oxo-1,3-oxolane)methyl (meth)acrylate), various types of alicyclic epoxy group-containing vinyl monomers (for example, 3,4-epoxycyclohexyl (meth)acrylate, 3,4-epoxycyclohexylmethyl (meth)acrylate, and 3,4-epoxycyclohexylethyl (meth)acrylate).

Examples of the vinyl monomer having an carboxyl group as the thermosetting reactive group include various types of carboxyl group-containing monomers (for example, (meth)

acrylic acid, crotonic acid, itaconic acid, maleic acid, and fumaric acid), various types of monoesters of an α,β-unsaturated dicarboxylic acid and a monohydroxy alcohol having from 1 to 18 carbon atoms (for example, monomethyl fumarate, monoethyl fumarate, monobutyl fumarate, monoisobutyl fumarate, mono-tert-butyl fumarate, monohexyl fumarate, monooctyl fumarate, mono-2-ethylhexyl fumarate, monomethyl maleate, monoethyl maleate, monobutyl maleate, monoisobutyl maleate, mono-tert-butyl maleate, monohexyl maleate, monooctyl maleate, and mono-2-ethylhexyl maleate), and itaconic acid monoalkyl esters (for example, monomethyl itaconate, monoethyl itaconate, monobutyl itaconate, monoisobutyl itaconate, monohexyl itaconate, monooctyl itaconate, and mono-2-ethylhexyl itaconate).

Examples of the vinyl monomer having an hydroxyl group as the thermosetting reactive group include various types of hydroxyl group-containing (meth)acrylates (for example, 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, polyethylene glycol mono (meth)acrylate, and polypropylene glycol mono(meth)acrylate), addition reaction products of the above-mentioned various types of hydroxyl group-containing (meth)acrylates and ε-caprolactone, various types of hydroxyl group-containing vinyl ethers (for example, 2-hydroxyethyl vinyl ether, 3-hydroxypropyl vinyl ether, 2-hydroxypropyl vinyl ether, 4-hydroxybutyl vinyl ether, 3-hydroxybutyl vinyl ether, 2-hydroxy-2-methylpropyl vinyl ether, 5-hydroxypentyl vinyl ether, and 6-hydroxyhexyl vinyl ether), addition reaction products of the above-mentioned various types of hydroxyl group-containing vinyl ethers and ε-caprolactone, various types of hydroxyl group-containing allyl ethers (for example, 2-hydroxyethyl (meth)allyl ether, 3-hydroxypropyl (meth)allyl ether, 2-hydroxypropyl (meth)allyl ether, 4-hydroxybutyl (meth)allyl ether, 3-hydroxybutyl (meth) allyl ether, 2-hydroxy-2-methylpropyl (meth)allyl ether, 5-hydroxypentyl (meth)allyl ether, and 6-hydroxyhexyl (meth)allyl ether), and addition reaction products of the above-mentioned various types of hydroxyl group-containing allyl ethers and ε-caprolactone.

The thermosetting (meth)acrylic resin may also be made through copolymerization with another vinyl monomer that does not have a curing reactive group, other than the (meth)acrylic monomer.

Examples of the vinyl monomer include various types of α-olefins (for example, ethylene, propylene, and butane-1), various types of halogenated olefins excluding fluoroolefin (for example, vinyl chloride, and vinylidene chloride), various types of aromatic vinyl monomers (for example, styrene, α-methylstyrene, and vinyl toluene), various types of diesters of an unsaturated dicarboxylic acid and a monohydroxy alcohol having from 1 to 18 carbon atoms (for example, fumaric acid dimethyl, diethyl fumarate, dibutyl fumarate, dioctyl fumarate, dimethyl maleate, diethyl maleate, dibutyl maleate, dioctyl maleate, dimethyl itaconate, diethyl itaconate, dibutyl itaconate, and dioctyl itaconate), various types of acid anhydride group-containing monomers (for example, maleic anhydride, itaconic anhydride, citraconic anhydride, (meth)acrylic anhydride, and tetrahydrophthalic anhydride), various types of phosphoric acid ester group-containing monomers (for example, diethyl-2-(meth)acryloyloxyethyl phosphate, dibutyl-2-(meth)acryloyloxybutyl phosphate, dioctyl-2-(meth)acryloyloxyethyl phosphate, and diphenyl-2-(meth)acryloyloxyethyl phosphate), various types of hydrolyzable silyl group-containing monomers (for example, γ-(meth) acryloyloxypropyltrimethoxysilane, γ-(meth) acryloyloxypropyltriethoxysilane, and γ-(meth) acryloyloxypropylmethyldimethoxysilane), various types of aliphatic vinyl carboxylates (for example, vinyl acetate, vinyl propionate, vinyl butyrate, vinyl isobutyrate, vinyl caproate, vinyl caprylate, vinyl caprate, vinyl laurate, branched aliphatic vinyl carboxylates having from 9 to 11 carbon atoms, and vinyl stearate), various types of carboxylic acid vinyl esters having a cyclic structure (for example, vinyl cyclohexanecarboxylate, vinyl methylcyclohexanecarboxylate, vinyl benzoate, and vinyl p-tert-butylbenzoate).

In addition, in the thermosetting (meth)acrylic resin, in a case where a vinyl monomer other than the (meth)acrylic monomer is used as the vinyl monomer having a thermosetting reactive group, an acrylic monomer which does not have a thermosetting reactive group is used.

Examples of the acrylic monomer which does not have a thermosetting reactive group include (meth)acrylic acid alkyl esters (for example, methyl (meth)acrylate, ethyl (meth)acrylate, n-propyl (meth)acrylate, isopropyl (meth) acrylate, n-butyl (meth)acrylate, isobutyl (meth)acrylate, tert-butyl (meth)acrylate, n-hexyl (meth)acrylate, cyclohexyl (meth)acrylate, 2-ethylhexyl (meth)acrylate, n-octyl (meth)acrylate, isooctyl (meth)acrylate, 2-ethyloctyl (meth) acrylate, dodecyl (meth)acrylate, isodecyl (meth)acrylate, lauryl (meth)acrylate, and stearyl (meth)acrylate), various types of (meth)acrylic acid aryl esters (for example, benzyl (meth)acrylate, phenyl (meth)acrylate, and phenoxy ethyl (meth)acrylate), various types of alkyl carbitol (meth)acrylates (for example, ethyl carbitol (meth)acrylate), other various types of (meth)acrylic acid esters (for example, isobornyl (meth)acrylate, dicyclopentanyl (meth)acrylate, dicyclopentenyl (meth)acrylate, dicyclopentenyloxyethyl (meth)acrylate, and tetrahydrofurfuryl (meth)acrylate), various types of amino group-containing amide unsaturated monomers (for example, N-dimethylaminoethyl (meth)acrylamide, N-diethylaminoethyl (meth)acrylamide, N-dimethylaminopropyl (meth)acrylamide, and N-diethylaminopropyl (meth)acrylamide), various types of dialkylaminoalkyl (meth)acrylates (for example, dimethylaminoethyl (meth) acrylate and diethylaminoethyl (meth)acrylate), various types of amino group-containing monomers (for example, tert-butylaminoethyl (meth)acrylate, tert-butylaminopropyl (meth)acrylate, aziridinyl ethyl (meth)acrylate, pyrrolidinyl ethyl (meth)acrylate, and piperidinyl ethyl (meth)acrylate).

As the thermosetting (meth)acrylic resin, an acrylic resin having a number-average molecular weight of from 1000 to 20,000 (preferably, from 1500 to 15,000).

When the number-average molecular weight is in the above range, the smoothness and the mechanical properties of the coating film are easily enhanced.

The number-average molecular weight of the thermosetting (meth)acrylic resin is measured by gel permeation chromatography (GPC). The molecular weight measurement by GPC is performed by using the HLC-8120 GPC system manufactured by Tosoh Corporation as the measuring apparatus, TSKgel SuperHM-M columns (15 cm) manufactured by Tosoh Corporation, and the THF solvent. The weight-average molecular weight and the number-average molecular weight are calculated by using a molecular weight calibration curve created by monodisperse polystyrene standard samples from the measurement results.

Thermosetting Polyester Resin

The thermosetting polyester resin is, for example, a polycondensate made by polycondensation of a polybasic acid and a polyol. The introduction of a curing reactive group of the thermosetting polyester resin is achieved by adjusting the use amount of the polybasic acid and the polyol. Through this adjustment, a thermosetting polyester resin having at least one of a carboxyl group and a hydroxyl group as the curing reactive group is obtained.

Examples of the polybasic acid include: terephthalic acid, isophthalic acid, phthalic acid, methylterephthalic acid, trimellitic acid, pyromellitic acid, and anhydrides of the acids; succinic acid, adipic acid, azelaic acid, sebacic acid, and anhydrides of the acids; maleic acid, itaconic acid, and anhydrides of the acids; fumaric acid, tetrahydrophthalic acid, methyltetrahydrophthalic acid, hexahydrophthalic acid, methylhexahydrophthalic acid, and anhydrides of the acids; cyclohexanedicarboxylic acid, and 2,6-naphthalenedicarboxylic acid.

Examples of the polyol include ethylene glycol, diethylene glycol, propylene glycol, dipropylene glycol, 1,3-butanediol, 1,4-butanediol, 1,5-pentanediol, 1,6-hexanediol, neopentyl glycol, triethylene glycol, bis-hydroxyethyl terephthalate, cyclohexanedimethanol, octanediol, diethylpropanediol, butyl ethyl propanediol, 2-methyl-1,3-propanediol, 2,2,4-trimethylpentanediol, hydrogenated bisphenol-A, an ethylene oxide adduct of hydrogenated bisphenol-A, a propylene oxide adduct of hydrogenated bisphenol-A, trimethylolethane, trimethylol propane, glycerin, pentaerythritol, tris-hydroxyethyl isocyanurate, and hydroxypivalyl hydroxypivalate.

The thermosetting polyester resin may also be subjected to polycondensation with another monomer other than the polybasic acid and the polyol.

Examples of the other monomer include a compound containing a carboxyl group and a hydroxyl group in a molecule (for example, dimethanol propionic acid and hydroxypivalate), a monoepoxy compound (for example, a glycidyl ester of a branched aliphatic carboxylic acid such as "Cardura E10 (manufactured by Shell Chemicals)"), various types of monohydroxy alcohols (for example, methanol, propanol, butanol, and benzyl alcohol), various types of monobasic acids (for example, benzoic acid, and p-tert-butyl benzoic acid), and various types of fatty acids (for example, castor oil fatty acid, coconut oil fatty acid, and soybean oil fatty acid).

The structure of the thermosetting polyester resin may be a branched structure or a linear structure.

As the thermosetting polyester resin, a polyester resin in which the sum of the acid value and the hydroxyl value is from 10 mg KOH/g to 250 mg KOH/g and the number-average molecular weight is from 1000 to 100,000.

When the sum of the acid value and the hydroxyl value is in the above range, the smoothness and the mechanical properties of the coating film are easily enhanced. When the number-average molecular weight is in the above range, the smoothness and the mechanical properties of the coating film are enhanced, and the storage stability of the powder coating material is easily enhanced.

The measurement of the acid value and the hydroxyl value of the thermosetting polyester resin is based on JIS K 0070:1992. The measurement of the number-average molecular weight of the thermosetting polyester resin is performed in the same manner as the measurement of the number-average molecular weight of the thermosetting (meth)acrylic resin.

Thermosetting resins may be used singly or in a combination of two or more types thereof.

The content of the thermosetting resin is preferably from 20% by weight to 99% by weight with respect to the total content of the powder particles and preferably from 30% by weight to 95% by weight.

In addition, when the thermosetting resin is applied as the resin of the resin coating portion, the content of the thermosetting resin means the total content of the thermosetting resins of the core and the resin coating portion.

—Hardener—

The hardener is selected according to the type of the curing reactive group of the thermosetting resin.

Specifically, in a case where the curing reactive group of the thermosetting resin is an epoxy group, examples of the hardener include: acids including succinic acid, glutaric acid, adipic acid, pimelic acid, suberic acid, azelaic acid, sebacic acid, dodecanedioic acid, eicosanedioic acid, maleic acid, citraconic acid, itaconic acid, glutaconic acid, phthalic acid, trimellitic acid, pyromellitic acid, tetrahydrophthalic acid, hexahydrophthalic acid, cyclohexene-1,2-dicarboxylic acid, trimellitic acid, and pyromellitic acid; anhydrides of the acids; and urethane-modified materials of the acids. Among these, as the hardener, an aliphatic dibasic acid is preferable in terms of the properties of the coating film and storage stability, and a dodecanedioic acid is particularly preferable in terms of the properties of the coating film.

In a case where the curing reactive group of the thermosetting resin is a carboxyl group, examples of the hardener include various types of epoxy resins (for example, polyglycidyl ether of bisphenol-A), epoxy group-containing acrylic resins (for example, glycidyl group-containing acrylic resin), various types of polyglycidyl ethers of polyols (for example, 1,6-hexanediol, trimethylolpropane, and trimethylolethane), various types of polyglycidyl esters of polycarboxylic acids (for example, phthalic acid, terephthalic acid, isophthalic acid, hexahydrophthalic acid, methylhexahydrophthalic acid, trimellitic acid, and pyromellitic acid), various types of alicyclic epoxy group-containing compounds (for example, bis(3,4-epoxycyclohexyl)methyl adipate), hydroxyamide (for example, triglycidyl isocyanurate, and β-hydroxyalkylamide).

In a case where the curing reactive group of the thermosetting resin is a hydroxyl group, examples of the hardener include polyblock isocyanate and aminoplast. Examples of polyblock polyisocyanate include: organic diisocyanates including various types of aliphatic diisocyanates (for example, hexamethylene diisocyanate, and trimethylhexamethylene diisocyanate), various types of alicyclic diisocyanates (for example, xylylene diisocyanate, and isophorone diisocyanate), various types of aromatic diisocyanates (for example, tolylene diisocyanate, and 4,4'-diphenylmethane diisocyanate); adducts of the organic diisocyanates and polyols, low-molecular-weight polyester resins (for example, polyester polyol), or water; polymers of organic diisocyanates (a polymer also including an isocyanurate-type polyisocyanate compound); various types of blocked polyisocyanate compounds such as an isocyanate biuret product, blocked by a well-known blocking agent; self-blocked polyisocyanate compound having an uretdione bond as a structure unit.

Hardeners may be used singly or in a combination of two or more types thereof.

The content of the hardener is preferably from 1% by weight to 30% by weight with respect to the content of the thermosetting resin, and preferably from 3% by weight to 20% by weight.

In a case where the thermosetting resin is applied as the resin of the resin coating portion, the content of the hardener means the total content of the thermosetting resins of the core and the resin coating portion.

—Colorant—

Examples of the colorant include a pigment. A dye may also be used together with the pigment as the colorant.

Examples of the pigment include: inorganic pigments including iron oxide (for example, red ocher), titanium oxide, titan yellow, zinc oxide, lead white, zinc sulfide, lithopone, antimony oxide cobalt blue, and carbon black; and organic pigments including quinacridone red, phthalocyanine blue, phthalocyanine green, permanent red, Hansa yellow, indanthrene blue, brilliant fast scarlet, and benzimidazolone yellow.

In addition, as the pigment, a brilliant pigment may also be employed. Examples of the brilliant pigment include: metal powder including pearl pigment, aluminum powder, and stainless steel powder; metal flake; glass beads; glass flake; mica; and flake-shaped iron oxide (MIO).

Colorants may be used singly or in a combination of two or more types thereof.

The content of the colorant is selected according to the type of the pigment, the color, brightness, and depth required of the coating film, and the like. For example, the content of the colorant is preferably from 1% by weight to 70% by weight with respect to the total content of the resins of the core and the resin coating portion, and preferably from 2% by weight to 60% by weight.

—Other Additives—

As the other additives, various types of additives used in the powder coating material may be employed. Specifically, examples of the other additives include surface adjusting agents (silicone oil, acrylic oligomers, and the like), foam inhibitors (for example, benzoin, and benzoin derivatives), curing accelerators (amine compounds, imidazole compounds, and cationic polymerization catalysts), plasticizers, charge-controlling agents, antioxidants, pigment dispersants, flame retardants, and fluidity imparting agents.

(Resin Coating Portion)

The resin coating portion contains a resin. The resin coating portion may be made of only a resin or may also contain other additives (the hardener described for the core, the other additives, and the like). However, in terms of a further reduction in the bleed of the powder particles, the resin coating portion may be made of only a resin. Even in a case where the resin coating portion contains the other additives, the resin may occupy 90% by weight or higher (preferably 95% by weight or higher) with respect to the total content of the resin coating portion.

The resin of the resin coating portion may be a non-curable resin or may also be a thermosetting resin. However, the resin of the resin coating portion may be a thermosetting resin in terms of the enhancement of the curing density (crosslink density) of the coating film. In a case where the thermosetting resin is applied as the resin of the resin coating portion, as the thermosetting resin, the same resin as the thermosetting resin of the core may be employed. Particularly, even in the case where the thermosetting resin is applied as the resin of the resin coating portion, the thermosetting resin is preferably at least one type selected from the group consisting of a thermosetting (meth)acrylic resin and a thermosetting polyester resin. However, the thermosetting resin of the resin coating portion may be the same type of thermosetting resin of the core or may be a different resin.

In a case where the non-curable resin is applied as the resin of the resin coating portion, as the non-curable resin, at least one type selected from the group consisting of an acrylic resin and a polyester resin is appropriately employed.

The coating ratio of the resin coating portion is preferably from 30% to 100% in terms of bleed prevention, and more preferably from 50% to 100%.

The coating ratio of the resin coating portion is a value obtained by XPS (X-ray photoelectron spectroscopy) measurement of the coating ratio of the resin coating portion on the surface of the powder particles.

Specifically, XPS measurement is performed by using the JPS-9000MX spectrometer manufactured by JEOL Ltd. as the measuring apparatus, using an MgKα source as the X-ray source, and setting an emission current to 30 mA.

From the spectrum obtained under the above conditions, a separation of peaks of the components caused by the material of the core of the surface of the powder particle and the components caused by the material of the resin coating portion is performed, and the coating ratio of the resin coating portion of the surface of the powder particle is determined. During the peak separation, the measured spectrum is separated into components by using curve fitting according to the least square method.

As the component spectrum as the base of the separation, a spectrum obtained by separately measuring the thermosetting resin, the hardener, the pigment, the additives, and the coating resin used to produce the powder particles is used. The coating ratio is obtained from the ratio of the spectrum intensity caused by the coating resin to the sum of the full spectrum intensities obtained from the powder particles.

The thickness of the resin coating portion is preferably from 0.2 μm to 4 μm in terms of bleed prevention, and more preferably from 0.3 μm to 3 μm.

The thickness of the resin coating portion is a value obtained by the following method. A thin piece is produced by embedding the powder particles in an epoxy resin or the like and cutting the resultant with a diamond knife or the like. The thin piece is observed by a transmission electron microscope (TEM) or the like, and the cross-sectional image of plural powder particles is photographed. From the cross-sectional image of the powder particles, the thickness of the resin coating portion is measured at 20 positions and the average value thereof is employed. In a case where it is difficult to observe the resin coating portion from the cross-sectional image in a clear powder coating material or the like, dyeing is performed for the observation to facilitate measurement.

(Other Components of Powder Particles)

The powder particles may contain divalent or higher metal ions (hereinafter, also simply referred to as "metal ions"). The metal ions are components contained in any of the core and the resin coating portion of the powder particles. When the divalent or higher metal ions are contained in the powder particles, ionic cross-links are formed by the metal ions in the powder particles. For example, in a case where a polyester resin is used as the thermosetting resin of the core and the resin of the resin coating portion, the carboxyl group or the hydroxyl group of the polyester resin and the metal ions interact with each other and form ionic cross-links. Due to the ionic cross-links, the bleed of the powder particles is prevented and thus storage properties are easily enhanced. In addition, the bonds of the ionic cross-links break by heating the ionic cross-links during curing after coating of the powder coating material. Therefore, the melt viscosity of the powder coating material is reduced, and thus a coating film having high smoothness is easily formed.

Examples of the metal ions include divalent to quadrivalent metal ions. Specifically, examples of the metal ions include at least one type of metal ions selected from the group consisting of aluminum ions, magnesium ions, iron ions, zinc ions, and calcium ions.

Examples of a supply source of the metal ions (a compound contained as the additive in the powder particles) include a metal salt, an inorganic metal salt polymer, and a metal complex. The metal salt and the inorganic metal salt polymer are added to the powder particles as an aggregating agent in a case of, for example, the powder particles are produced by an aggregation and coalescence method.

Examples of the metal salt include aluminum sulfate, aluminum chloride, magnesium chloride, magnesium sulfate, iron dichloride, zinc chloride, calcium chloride, and calcium sulfate.

Examples of the inorganic metal salt polymer include polyaluminum chloride, polyaluminum hydroxide, polyferric sulfate, and calcium polysulfide.

Examples of the metal complex include a metal salt of aminocarboxylic acid. Specifically, examples of the metal complex include metal salts (for example, calcium salt, magnesium salt, iron salt, and aluminum salt) based on a well-known chelate such as ethylenediaminetetraacetic acid, propanediaminetetraacetic acid, nitrilotriacetic acid, triethylenetetraaminehexaacetic acid, and diethylenetriaminepentaacetic acid.

The supply source of the metal ions may also be simply added as an additive not for an aggregating agent.

As the valence of the metal ions increases, mesh-like ionic cross-links are more likely to be formed, which is preferable in terms of the smoothness of the coating film and the storage properties of the powder coating material. Therefore, as the metal ions, Al ions are preferable. That is, as the supply source of the metal ions, aluminum salts (for example, aluminum sulfate and aluminum chloride), and a polymer of an aluminum salt (for example, polyaluminum chloride and polyaluminum hydroxide) are preferable. Furthermore, in terms of the smoothness of the coating film and the storage properties of the powder coating material, among the supply sources of the metal ions, an inorganic metal salt polymer is more preferable than metal salts even when the valence of the metal ions is the same. Therefore, as the supply source of the metal ions, the polymer of an aluminum salt (for example, polyaluminum chloride and polyaluminum hydroxide) is preferable.

The content of the metal ions is preferably from 0.002% by weight to 0.2% by weight with respect to the total content of the powder particles and more preferably from 0.005% by weight to 0.15% by weight in terms of the smoothness of the coating film and the storage properties of the powder coating material.

When the content of the metal ions is equal to or higher than 0.002% by weight, appropriate ionic cross-links are formed by the metal ions and thus the bleed of the powder particles is prevented. Therefore, the storage properties of the coating material are easily enhanced. On the other hand, when the content of the metal ions is equal to or less than 0.2% by weight, an excessive formation of ionic cross-links due to the metal ions is prevented, and thus the smoothness of the coating film is easily enhanced.

Here, in a case where the powder particles are produced by the aggregation and coalescence method, the supply source of the metal ions (metal salts, and a metal salt polymer) added as the aggregating agent contributes to the control of the particle size distribution and shapes of the powder particles.

Specifically, a higher valence of the metal ions is more appropriate to obtain a narrow particle size distribution. In addition, in order to obtain a narrow particle size distribution, a metal salt polymer is more appropriate than metal salts even when the valence of the metal ions is the same. Therefore, for the above reasons, as the supply source of the metal ions, aluminum salts (for example, aluminum sulfate and aluminum chloride), and a polymer of an aluminum salt (for example, polyaluminum chloride and polyaluminum hydroxide) are preferable, and a polymer of an aluminum salt (for example, polyaluminum chloride and polyaluminum hydroxide) are particularly preferable.

When the aggregating agent is added so that the content of the metal ions is equal to or higher than 0.002% by weight, the aggregation of resin particles in an aqueous medium proceeds, which contributes to the realization of a narrow particle size distribution. In addition, the aggregation of resin particles which form the resin coating portion proceeds for the aggregated particles which form the core, which contributes to the realization of the formation of the resin coating portion for the entire surface of the core. On the other hand, when the aggregating agent is added so that the content of the metal ions is equal to or less than 0.2% by weight, an excessive formation of the ionic cross-links in the aggregated particles is prevented. Therefore, when the particles are coalesced, the shapes of the formed powder particles are likely to become spherical shapes. Therefore, for the above reasons, the content of the metal ions is preferably from 0.002% by weight to 0.2% by weight and more preferably from 0.005% by weight to 0.15% by weight.

The content of the metal ions is measured by quantitatively analyzing the intensity of fluorescent X-rays of the powder particles. Specifically, for example, first, a resin mixture in which the metal ions have a known concentration is obtained by mixing a resin and the supply source of the metal ions. 200 mg of the resin mixture is pelletized by a pelletizing machine having a diameter of 13 mm, thereby obtaining a pellet sample. The mass of the pellet sample is precisely weighed, and fluorescent X-ray intensity measurement of the pellet sample is performed, thereby obtaining peak intensities. Similarly, the measurement is also performed on pellet samples in which the amount of the supply source of the metal ions being added varies, and a calibration curve is created from the measurement results. By using the calibration curve, the content of the metal ions in the powder particles as the measuring object is quantitatively analyzed.

Examples of the method of adjusting the content of the metal ions include 1) a method of adjusting the amount of the supply source of the metal ions being added, and 2) in a case where the powder particles are produced by the aggregation and coalescence method, a method of adjusting the content of the metal ions by adding an aggregating agent (for example, metal salts or a metal salt polymer) as the supply source of the metal salts in an aggregation process, thereafter adding a chelating agent (for example, EDTA (ethylenediaminetetraacetic acid), DTPA (diethylenetriaminepentaacetic acid), and NTA (nitrilotriacetic acid)) thereto at the end of the aggregation process, forming a complex with the metal ions by the chelating agent, and removing the formed complex salts in a subsequent washing process or the like.

(External Additives)

The external additives prevent the generation of aggregates of the powder particles to form a coating film having high smoothness with a small amount of material. Specific examples of the external additives include inorganic particles. Examples of the inorganic particles include particles such as $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $Cao.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles as the external additives may be subjected to a hydrophobizing treatment. The hydrophobizing treatment is performed by, for example, dipping the inorganic particles in a hydrophobizing agent or the like. The hydrophobizing agent is not particularly limited, and examples thereof include a silane coupling agent, silicone oil, a titanate coupling agent, and an aluminum coupling agent. The agents may be used singly or in a combination of two or more types thereof.

Typically, the amount of the hydrophobizing agent is, for example, from 1 parts by weight to 10 parts by weight with respect to 100 parts by weight of the inorganic particles.

The amount of the external additives being externally added is, for example, preferably from 0.01% by weight to 5% by weight with respect to the amount of the powder particles and more preferably from 0.01% by weight to 2.0% by weight.

[Method of Producing Powder Coating Material]

Next, a method of producing the powder coating material according to this exemplary embodiment will be described.

The powder coating material according to this exemplary embodiment is obtained by producing the powder particles and thereafter externally adding the external additives to the powder particles as necessary.

The powder particles may be produced by any of a dry production method (for example, a kneading and pulverizing method) and a wet production method (for example, an aggregation and coalescence method, a suspension polymerization method, and a dissolution suspension method). The method of producing the powder particles is not particularly limited to the above production methods, and a well-known production method may also be employed.

Among these, in order to easily control the volume particle size distribution index GSDv and the average circularity to be in the above ranges, the powder particles may be obtained by the aggregation and coalescence method.

Specifically, the powder particles may be produced through processes of:

forming first aggregated particles by allowing, in a dispersion in which first resin particles containing a thermosetting resin, and a hardener are dispersed, the first resin particles and the hardener to aggregate, or by allowing, in a dispersion in which composite particles containing a thermosetting resin and a hardener are dispersed, the composite particles to aggregate;

mixing a first aggregated particle dispersion in which the first aggregated particles are dispersed with a second resin particle dispersion in which second resin particles containing a resin are dispersed, and forming second aggregated particles in which the second resin particles stick to the surfaces of the first aggregated particles by allowing aggregation in which the second resin particles stick to the surfaces of the first aggregated particles; and heating a second aggregated particle dispersion in which the second aggregated particles are dispersed to allow the second aggregated particles to be coalesced to each other.

In addition, in the powder particles produced by the aggregation and coalescence method, a part in which the first aggregated particles are coalesced becomes the core, and a part in which the second resin particles sticking to the surfaces of the first aggregated particles are coalesced becomes the resin coating portion.

Hereinafter, details of each process will be described.

In the following description, a method of producing the powder particles containing a colorant is described. However, the colorant is contained as necessary.

—Process of Preparing Each Dispersion—

First, each of the dispersions used in the aggregation and coalescence method is used. Specifically, a first resin particle dispersion in which the first resin particles containing the thermosetting resin of the core are dispersed, a hardener dispersion in which the hardener is dispersed, a colorant dispersion in which the colorant is dispersed, and the second resin particle dispersion in which the second resin particles containing the resin of the resin coating portion are dispersed are prepared.

In addition, instead of the first resin particle dispersion and the hardener dispersion in which the hardener is dispersed, a composite particle dispersion in which the composite particles containing the thermosetting resin of the core and the hardener are dispersed is prepared.

In addition, in the process of preparing each dispersion, the first resin particles, the second resin particles, and the dispersion are collectively called "resin particles" in the description.

Here, the resin particle dispersion is prepared by, for example, dispersing the resin particles in a dispersion medium using a surfactant.

Examples of the dispersion medium used in the resin particle dispersion include an aqueous medium.

Examples of the aqueous medium include: water such as distilled water or ion-exchange water; and alcohols. These may be used singly or in a combination of two or more types thereof.

Examples of the surfactant include: anionic surfactants based on sulfate esters, sulfonates, phosphate esters, soaps, and the like; cationic surfactants based on amines, quaternary ammonium salts, and the like; and nonionic surfactants based on polyethylene glycol, alkyl phenol ethylene oxide adducts, polyols, and the like. Among these, the anionic surfactants and the cationic surfactants are particularly employed. The nonionic surfactants may be used together with the anionic surfactants or the cationic surfactants.

The surfactants may be used singly or in a combination of two or more types thereof.

Regarding the resin particle dispersion, examples of the method of dispersing the resin particles in the dispersion medium include general dispersing methods such as a rotary shear homogenizer, a ball mill having a medium, a sand mill, and a dyno mill. Depending on the type of the resin particles, for example, the resin particles may be dispersed in the resin particle dispersion using a phase inversion emulsification method.

The phase inversion emulsification method is a method of dissolving a resin to be dispersed in a hydrophobic organic solvent in which the resin is soluble, adding a basic group to an organic continuous phase (O phase) for neutralization, and an aqueous medium (W phase) is injected thereto for resin conversion (so-called phase inversion) from W/O to O/W to form discontinuous phases such that the resin is dispersed in the aqueous medium in a particle form.

As the method of producing the resin particle dispersion, specifically, for example, in a case of an acrylic resin particle dispersion, a raw material monomer is emulsified in water of an aqueous medium, and a water-soluble initiator, and as necessary, a chain transfer agent for controlling a molecular weight are added thereto, and the resultant is heated and is subjected to emulsion polymerization, thereby obtaining a resin particle dispersion in which the acrylic resin particles are dispersed.

In a case of a polyester resin particle dispersion, a raw material monomer is heated, dissolved, and subjected to polycondensation under reduced pressure, and the obtained polycondensate is added to a solvent (for example, ethyl acetate) and is dissolved, and the obtained dissolved material is stirred and subjected to phase inversion emulsification while an alkalescent aqueous solution is added thereto, thereby obtaining a resin particle dispersion in which the polyester resin particles are dispersed.

In a case of obtaining a composite particle dispersion, the resin and the hardener are mixed and dispersed in a dispersion medium (for example, emulsified through phase inversion emulsification or the like), thereby obtaining the corresponding composite particle dispersion.

The volume-average particle size of the resin particles dispersed in the resin particle dispersion may be, for example, equal to or less than 1 μm, and is preferably from 0.01 μm to 1 μm, more preferably from 0.08 μm to 0.8 μm, and even more preferably from 0.1 μm to 0.6 μm.

Regarding the volume-average particle size of the resin particles, a cumulative distribution of volumes is drawn based on the particle size distribution obtained through measurement using a laser diffraction particle size distribution measuring apparatus (for example, LA-700 manufactured by HORIBA, Ltd.) from a small diameter side in terms of discrete particle size ranges (channels). A particle size which achieves cumulative 50% with respect to the total particles is defined as a volume-average particle size D50v. The volume-average particle size of particles in the other dispersions is measured in the same manner.

The content of the resin particles contained in the resin particle dispersion is, for example, preferably from 5% by weight to 50% by weight, and more preferably from 10% by weight to 40% by weight.

In the same manner as the resin particle dispersion, for example, the hardener dispersion, the colorant dispersion, and the composite particle dispersion are also prepared. That is, in the same manner as the volume-average particle size, the dispersion medium, the dispersing method, and the content of the resin particles in the resin particle dispersion, the particles of the colorant dispersed in the colorant dispersion, the particles of the hardener dispersed in the hardener dispersion, and the composite particles dispersed in the composite particle dispersion are obtained.

—Process of Forming First Aggregated Particles—

Next, the first resin particle dispersion, the hardener dispersion, and the colorant dispersion are mixed with each other.

In the mixed dispersion, the first aggregated particles are formed which contain the first resin particles, the hardener, and the colorant and have a diameter close to the diameter of target powder particles by allowing the first resin particles, the hardener, and the colorant to undergo heteroaggregation.

Specifically, for example, the aggregating agent is added to the mixed dispersion, the pH of the mixed dispersion is adjusted to be acidic (for example, a pH of from 2 to 5), a dispersion stabilizer is added as necessary, and the resultant is then heated to a temperature of the glass-transition temperature of the first resin particles (specifically, for example, from a temperature 30° C. lower than the glass transition temperature of the first resin particles to a temperature 10° C. lower than the glass transition temperature of the first resin particles) to allow the particles dispersed in the mixed dispersion to aggregate, thereby forming the first aggregated particles.

Alternatively, in the process of forming the first aggregated particles, the composite particle dispersion containing the thermosetting resin and the hardener and the colorant dispersion may be mixed with each other to allow the composite particles and the colorant in the mixed dispersion to undergo heteroaggregation, thereby forming the first aggregated particles.

In the process of forming the first aggregated particles, for example, the heating may be performed after stirring the mixed dispersion by a rotary shear homogenizer, adding the aggregating agent at room temperature (for example, 25° C.), adjusting the pH of the mixed dispersion to be acidic (for example, a pH of from 2 to 5), and adding the dispersion stabilizer as necessary.

Examples of the aggregating agent include a surfactant having the opposite polarity to the surfactant used as the dispersant added to the mixed dispersion, metal salts, a metal salt polymer, and a metal complex. In a case where the metal complex is used as the aggregating agent, the amount of the surfactant being used is reduced and thus charging properties are enhanced.

After the aggregation ends, an additive to forma complex with metal ions or similar bonds may be used as necessary. As the additive, a chelating agent is appropriately used. In a case where the aggregating agent is excessively added, the adjustment of the content of the metal ions of the powder particles is obtained by the addition of the chelating agent.

Here, metal salts as the aggregating agent, a metal salt polymer, and a metal complex are used as the supply source of the metal ions. Exemplification thereof is described above.

As the chelating agent, an aqueous chelating agent may be employed. Specifically, examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent being added may be, for example, from 0.01 parts by weight to 5.0 parts by weight with respect to 100 parts by weight of the resin particles, and is preferably equal to or higher than 0.1 parts by weight and less than 3.0 parts by weight.

—Process of Forming Second Aggregated Particles—

Next, the first aggregated particle dispersion in which the obtained first aggregated particles are dispersed and the second resin particle dispersion are mixed with each other.

The second resin particles may be the same type as the first resin particles or may be a different type.

In addition, the second aggregated particles in which the second resin particles stick to the surfaces of the first aggregated particles are formed by allowing aggregation in which, in the mixed dispersion in which the first aggregated particles and the second resin particles are dispersed, the second resin particles stick to the surfaces of the first aggregated particles.

Specifically, for example, when the first aggregated particles reach a desired particle size in the process of forming the first aggregated particles, the second resin particle dispersion is mixed with the first aggregated particle dispersion, and heating is performed on the mixed dispersion at a temperature of equal to or less than the glass-transition temperature of the second resin particles.

In addition, by adjusting the pH of the mixed dispersion to be in a range of, for example, from 6.5 to 8.5, the progress of the aggregation is stopped.

Accordingly, the second aggregated particles aggregated so that the second resin particles stick to the surfaces of the first aggregated particles are obtained.

—Coalescence Process—

Next, the second aggregated particle dispersion in which the second aggregated particles are dispersed is heated at a temperature of equal to or higher than the glass-transition temperature of the first and second resin particles (for example, equal to or higher than a temperature higher than the glass-transition temperature of the first and second resin particles by 10 to 30° C.) to allow the second aggregated particles to be coalesced, thereby forming the powder particles.

The powder particles are obtained through the above processes.

Here, after the coalescence process ends, the powder particles formed in the dispersion are subjected to a well-known washing process, a solid-liquid separation process, and a drying process to obtain powder particles in a dried state.

As the washing process, in terms of charging properties, displacement washing by ion-exchange water may be sufficiently performed. In addition, although the solid-liquid separation process is not particularly limited, in terms of productivity, suction filtration, pressure filtration, or the like may be performed. In addition, although the drying process is not particularly limited to methods, in terms of productivity, freeze-drying, flash drying, fluidized drying, vibratory fluidized drying, or the like may be performed.

The powder coating material according to this exemplary embodiment is produced by, for example, adding and mixing the external additives as necessary with the obtained powder particles in a dried state. The mixing may be performed by, for example, a V blender, a Henschel mixer, and a Lödige mixer. Furthermore, as necessary, toner coarse particles may be removed by using a vibratory sieving machine, a wind classifier, or the like.

Hereinafter, test examples which prove the effects of the powder coating material according to this exemplary embodiment are described. The powder coating material according to this exemplary embodiment is not limited to the test examples. In the following description, unless otherwise noted, both of "parts" and "%" are based on mass.

<Preparation of Colorant Dispersion>

(Preparation of Colorant Dispersion (C1))

Cyan pigment (C.I.Pigment Blue 15:3 manufactured by Dainichiseika Color & Chemicals Mfg. Co., Ltd., (copper phthalocyanine)): 100 parts by weight Anionic surfactant (Dai-ichi Kogyo Seiyaku Co., Ltd.: Neogen RK): 15 parts by weight Ion-exchange water: 450 parts by weight The above components are mixed, dissolved, and dispersed by using the high pressure impact type dispersing machine ULTIMIZER (HJP30006 manufactured by Sugino Machine Limited) for one hour such that a colorant dispersion in which the cyan pigment is dispersed is prepared. The volume-average particle size of the cyan pigment in the colorant dispersion is 0.13 μm, and the solid content of the colorant dispersion is 25%.

(Preparation of Colorant Dispersion (M1))

A colorant dispersion (M1) is prepared by the same method as that of the colorant dispersion (C1) except that the cyan pigment is changed to a magenta pigment (quinacridon pigment: Chromofine Magenta 6887 manufactured by Dainichiseika Color & Chemicals Mfg. Co., Ltd.). The volume-average particle size of the magenta pigment in the colorant dispersion is 0.14 μm, and the solid content of the colorant dispersion is 25%.

(Preparation of Colorant Dispersion (M2))

A colorant dispersion (M2) is prepared by the same method as that of the colorant dispersion (C1) except that the cyan pigment is changed to a magenta pigment (Fastogen Super Red 7100Y-E manufactured by DIC Corporation). The volume-average particle size of the magenta pigment in the colorant dispersion is 0.14 μm, and the solid content of the colorant dispersion is 25%.

(Preparation of Colorant Dispersion (Y1))

A colorant dispersion (Y1) is prepared by the same method as that of the colorant dispersion (C1) except that the cyan pigment is changed to a yellow pigment (Paliotol Yellow D 1155 manufactured by BASF Company Ltd.). The volume-average particle size of the magenta pigment in the colorant dispersion is 0.13 μm, and the solid content of the colorant dispersion is 25%.

(Preparation of Colorant Dispersion (K1))

A colorant dispersion (K1) is prepared by the same method as that of the colorant dispersion (C1) except that the cyan pigment is changed to a black pigment (Reagal 330 manufactured by Cabot Corporation). The volume-average particle size of the magenta pigment in the colorant dispersion is 0.11 μm, and the solid content of the colorant dispersion is 25%.

(Preparation of Colorant Dispersion (W1))

Titanium oxide (A-220 manufactured by Ishihara Sangyo Kaisha, Ltd.): 100 parts by weight Anionic surfactant (Dai-ichi Kogyo Seiyaku Co., Ltd.: Neogen RK): 15 parts by weight Ion-exchange water: 400 parts by weight The above components are mixed, dissolved, and dispersed by using the high pressure impact type dispersing machine ULTIMIZER (HJP30006 manufactured by Sugino Machine Limited) for 3 hours such that a colorant dispersion in which the titanium oxide is dispersed is prepared. When measurement is performed by using a laser diffraction particle size measuring machine, the volume-average particle size of the titanium oxide in the colorant dispersion is 0.25 and the solid content of the colorant dispersion is 25%.

TEST EXAMPLE 1

Clear Powder Coating Material Made of Acrylic Resin (PCA1)

(Preparation of Thermosetting Acrylic Resin Particle Dispersion (A1))

Styrene: 160 parts by weight

Methyl methacrylate: 200 parts by weight n-butylacrylate: 140 parts by weight

Acrylic acid: 12 parts by weight

Glycidyl methacrylate: 100 parts by weight

Dodecanethiol: 12 parts by weight

The above components are mixed and dissolved such that a monomer solution A is prepared.

On the other hand, 12 parts by weight of the anionic surfactant (DOWFAX manufactured by The Dow Chemical Company) are dissolved in 280 parts by weight of the ion-exchange water, the monomer solution A is added thereto, and the resultant is dispersed and emulsified in a flask such that a solution (monomer emulsified liquid A) is obtained.

Next, 1 parts by weight of the anionic surfactant (DOWFAX manufactured by The Dow Chemical Company) are dissolved in 555 parts by weight of the ion-exchange water, and the resultant is put into a flask for polymerization. Thereafter, the flask for polymerization is airtightly sealed, a recirculation pipe is provided, and nitrogen is injected thereto. While the result is slowly stirred, the flask for polymerization is heated by a water bath to 75° C. and is held.

In this state, a solution obtained by dissolving 9 parts by weight of ammonium persulfate in 43 parts by weight of the ion-exchange water is dropped for 20 minutes by a metering pump, and the monomer emulsified liquid A is further dropped for 200 minutes via a metering pump. After ending the dropping, the flask for polymerization is held at 75° C. for 3 hours while the resultant is slowly stirred, and the polymerization is ended such that an anionic thermosetting acrylic resin particle dispersion (A1) having a solid amount of 42% is obtained.

The volume-average particle size of the thermosetting acrylic resin particles contained in the anionic thermosetting acrylic resin particle dispersion (A1) is 220 nm, the glass-transition temperature thereof is 55° C., and the weight-average molecular weight thereof is 24,000.

(Preparation of Hardener Dispersion (D1))

Dodecanedioic acid: 50 parts by weight
Benzoin: 1 parts by weight
Acrylic oligomer (Acronal 4F, BASF Company Ltd.): 1 parts by weight
Anionic surfactant (DOWFAX manufactured by The Dow Chemical Company): 5 parts by weight
Ion-exchange water: 200 parts by weight The above components are heated in a pressure container at 140° C. and are dispersed by using a homogenizer (ULTRA-TURRAX T50 manufactured by IKA Corporation), and the resultant is then subjected to a dispersion treatment by the Manton-Gaulin high pressure homogenizer (Manton-Gaulin Manufacturing Co., Inc.) such that a hardener dispersion (D1) (a hardener concentration of 23%) in which the hardener having an average particle size of 0.24 μm and the other additives are dispersed is prepared.

(Preparation of Clear Powder Coating Material (PCA1))

—Aggregation Process—

Thermosetting acrylic resin particle dispersion (A1): 200 parts by weight (the resin content is 84 parts by weight)
Hardener dispersion (D1): 91 parts by weight (the hardener content is 21 parts by weight)
10% polyaluminum chloride: 1 parts by weight The above components are sufficiently mixed and dispersed by the homogenizer (ULTRA-TURRAX T50 manufactured by IKA Corporation) in a stainless steel round flask, are heated to 48° C. while stirring the flask in a heating oil bath, and are held at 48° C. for 60 minutes. Thereafter, 68 parts by weight (the resin content is 28.56 parts by weight) of the thermosetting acrylic resin particle dispersion (A1) is added, and the resultant is slowly stirred.

—Coalescence Process—

Thereafter, the pH of the solution in the flask is adjusted to 5.0 using 0.5 mol/liter of a sodium hydroxide aqueous solution, and the liquid is then heated to 95° C. while being continuously stirred. After the heating of the solution in the flask to 85° C. is ended, this state is maintained for 4 hours. The pH of the solution when the temperature is maintained at 85° C. is about 4.0.

—Filtration, Washing, and Drying Process—

After the reaction ends, the solution in the flask is cooled and filtered such that a solid is obtained. Next, the solid is sufficiently washed by ion-exchange water and is then subjected to solid-liquid separation through Nutsche suction filtration such that a solid is re-obtained.

Next, the solid is re-dispersed in 3 liters of ion-exchange water at 40° C. and was stirred and washed at 300 rpm for 15 minutes. The washing operation is repeated 5 times, and the solid obtained by the solid-liquid separation through the Nutsche suction filtration is subjected to vacuum drying for 12 hours. Thereafter, 0.5 parts by weight of hydrophobic silica particles (a primary particle size of 16 nm) is added to 100 parts by weight of the solid as the external additive such that the clear powder coating material (PCA1) made of an acrylic resin is obtained.

The volume-average particle size D50v of the powder particles of the clear powder coating material is 5.9 μm, the volume-average particle size distribution index GSDv is 1.20, and the average circularity is 0.99.

The clear powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the powder particles of the clear powder coating material is 0.08% by weight.

TEST EXAMPLE 2

Colored Powder Coating Material (PCE1) Made of Polyester Resin (Preparation of Thermosetting Polyester Resin (PES1))

A raw material having the following composition is put into a reaction container provided with a stirrer, a thermometer, a nitrogen gas inlet port, and a rectifier, and is subjected to a polycondensation reaction by increasing the temperature of the raw material to 240° C. while stirring the raw material under a nitrogen atmosphere.

Terephthalic acid: 742 parts by weight (100 mol %)
Neopentyl glycol: 312 parts by weight (62 mol %)
Ethylene glycol: 59.4 parts by weight (20 mol %)
Glycerin: 90 parts by weight (18 mol %)
Di-n-butyltin oxide: 0.5 parts by weight In the obtained thermosetting polyester resin, the glass-transition temperature is 55° C., the acid value (Av) is 8 mg KOH/g, the hydroxyl value (OHv) is 70 mg KOH/g, the weight-average molecular weight is 26,000, and the number-average molecular weight is 8000.

(Preparation of Composite Particle Dispersion (E1))

While a jacketed 3-liter reaction vessel (BJ-30N manufactured by Tokyo Rikakikai Co., LTD.) provided with a condenser, a thermometer, a water-dropping device, and an anchor blade is maintained at 40° C. in a water-circulating thermostatic bath, a mixed solvent of 180 parts by weight of ethyl acetate and 80 parts by weight of isopropyl alcohol is injected into the reaction vessel, and the following composition is injected into the resultant.

Thermosetting polyester resin (PES1): 240 parts by weight
Blocked isocyanate hardener VESTAGON B 1530 (manufactured by Evonik Japan Co., Ltd.): 60 parts by weight
Benzoin: 3 parts by weight
Acrylic oligomer (Acronal 4F, BASF Company Ltd.): 3 parts by weight After the injection, the resultant is stirred at 150 rpm using a three-one motor to be dissolved such that an oil phase is obtained. In the oil phase being stirred, 1 parts by weight of 10% by weight of an ammonia aqueous solution and 47 parts by weight of 5% by weight of a sodium hydroxide aqueous solution are dropped for 5 minutes and are mixed for 10 minutes. Thereafter, 900 parts by weight of ion-exchange water is dropped at a speed of 5 parts by weight per minute for phase inversion such that an emulsified liquid is obtained.

800 parts by weight of the obtained emulsified liquid and 700 parts by weight of the ion-exchange water are put into a 2-liter eggplant flask, and the resultant is set in an evaporator (manufactured by Tokyo Rikakikai Co., LTD.) provided with a vacuum control unit via trap balls. While rotating the eggplant flask, the resultant is heated by a hot water bath at 60° C. and is decompressed to 7 kPa while being careful of bumping such that a solvent is removed therefrom. At the time when the amount of the solvent being collected becomes 1100 parts by weight, the pressure is returned to the normal pressure, and the eggplant flask is water-cooled such that a dispersion is obtained. There is no solvent odor in the obtained dispersion. In the dispersion, the volume-average particle size of the composite particles containing the thermosetting polyester resin and the hardener is 150 nm.

Thereafter, 2% by weight of an anionic surfactant (DOWFAX 2A1 manufactured by The Dow Chemical Company, the amount of effective components is 45% by weight) is added and mixed as an effective component with respect to the resin component in the dispersion, and the concentration of the solid thereof is adjusted to 20% by weight by adding ion-exchange water. This is used as a composite particle dispersion (E1) containing the polyester resin and the hardener.

(Preparation of Thermosetting Polyester Resin Particle Dispersion (E2))

A thermosetting polyester resin particle dispersion (E2) is obtained under the same conditions as those for preparing the composite particle dispersion (E1) except that 300 parts by weight of the thermosetting polyester resin (PES1) is used and the blocked isocyanate hardener, the benzoin, and the acrylic oligomer are not added.

(Preparation of Colored Powder Coating Material (PGE1))

—Aggregation Process—

Composite particle dispersion (E1): 325 parts by weight (the solid content is 65 parts by weight)

Colorant dispersion (C1): 3 parts by weight (the solid content is 0.75 parts by weight)

Colorant dispersion (W1): 150 parts by weight (the solid content is 37.5 parts by weight)

The above components are sufficiently mixed and dispersed by the homogenizer (ULTRA-TURRAX T50 manufactured by IKA Corporation) in a stainless steel round flask. Next, the pH of the resultant is adjusted to 2.5 by using a 1.0% nitric acid aqueous solution. 0.50 parts by weight of a 10% polyaluminum chloride aqueous solution is added thereto, and the dispersing operation is continuously performed by the ULTRA-TURRAX.

A stirrer and a heating mantle are installed to increase the temperature of the resultant to 50° C. while appropriately adjusting the rotation frequency of the stirrer so as to sufficiently stir the slurry. After holding the resultant for 15 minutes at 50° C., 100 parts by weight of the thermosetting polyester resin dispersion (E2) is slowly injected so that the volume-average particle size of the resultant becomes 5.5 μm.

—Coalescence Process—

After the injection, the resultant is held for 30 minutes, and the pH thereof is adjusted to 6.0 by using a 5% sodium hydroxide aqueous solution. Thereafter, the temperature thereof is increased to 85° C. and is held for 2 hours. Substantially spheroidized particles are observed by an optical microscope.

—Filtration, Washing, and Drying Process—

After the reaction ends, the solution in the flask is cooled and filtered such that a solid is obtained. Next, the solid is sufficiently washed by ion-exchange water and is then subjected to solid-liquid separation through Nutsche suction filtration such that a solid is re-obtained.

Next, the solid is re-dispersed in 3 liters of ion-exchange water at 40° C. and is stirred and washed at 300 rpm for 15 minutes. The washing operation is repeated 5 times, and the solid obtained by the solid-liquid separation through the Nutsche suction filtration is subjected to vacuum drying for 12 hours. Thereafter, 0.5 parts by weight of hydrophobic silica particles (a primary particle size of 16 nm) is added to 100 parts by weight of the solid as the external additive such that the colored powder coating material (PCE1) made of a polyester resin is obtained.

The volume-average particle size D50v of the powder particles of the colored powder coating material is 6.5 the volume-average particle size distribution index GSDv is 1.24, and the average circularity is 0.98.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.1% by weight.

TEST EXAMPLE 3

Colored Powder Coating Material (PCE2) Made of Polyester

A colored powder coating material (PCE2) made of a polyester resin is obtained under the same conditions as those in Test Example 2 except that, after injecting 100 parts by weight of the thermosetting polyester resin particle dispersion (E2), 40 parts by weight of a 10% NTA (nitrilotriacetic acid) metal salt aqueous solution (CHELEST 70 manufactured by Chelest Co., Ltd.) are added, and the pH thereof is then adjusted to 6.0 by using a 5% sodium hydroxide aqueous solution.

The volume-average particle size D50v of the powder particles of the colored powder coating material is 6.8 μm, the volume-average particle size distribution index GSDv is 1.22, and the average circularity is 0.99.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

The content of aluminum ions in the colored powder coating material (the powder particles thereof) is 0.005% by weight.

TEST EXAMPLE 4

Clear Powder Coating Material (PCA2) Made of Acrylic Resin

A clear powder coating material (PCA2) made of an acrylic resin is obtained under the same conditions as those in Test Example 1 except that 1 parts by weight of the 10% polyaluminum chloride is changed to 4 parts by weight of 5% magnesium chloride in the aggregation process.

The volume-average particle size D50v of the powder particles of the clear powder coating material is 7.0 μm, the volume-average particle size distribution index GSDv is 1.35, and the average circularity is 0.97.

The clear powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

The content of magnesium ions in the clear powder coating material (the powder particles thereof) is 0.17% by weight.

TEST EXAMPLE 5

Colored Powder Coating Material (PCA3) Made of Acrylic Resin (Preparation of Thermosetting Acrylic Resin Particle Dispersion (A2))

Styrene: 60 parts by weight

Methyl methacrylate: 240 parts by weight

Hydroxyethyl methacrylate: 50 parts by weight

Carboxyethyl acrylate: 18 parts by weight

Glycidyl methacrylate: 260 parts by weight

Dodecanethiol: 8 parts by weight

The above components are mixed and dissolved such that a monomer solution A is prepared.

On the other hand, 12 parts by weight of the anionic surfactant (DOWFAX manufactured by The Dow Chemical Company) are dissolved in 280 parts by weight of the ion-exchange water, the monomer solution A is added thereto, and the resultant is dispersed and emulsified in a flask such that a solution (monomer emulsified liquid A) is obtained.

Next, 1 parts by weight of the anionic surfactant (DOWFAX manufactured by The Dow Chemical Company) are dissolved in 555 parts by weight of the ion-exchange water, and the resultant is put into a flask for polymerization. Thereafter, the flask for polymerization is airtightly sealed, a recirculation pipe is provided, and nitrogen is injected thereto. While the result is slowly stirred, the flask for polymerization is heated by a water bath to 75° C. and is held.

In this state, a solution obtained by dissolving 9 parts by weight of ammonium persulfate in 43 parts by weight of the ion-exchange water is dropped for 20 minutes by a metering pump, and the monomer emulsified liquid A is further dropped for 200 minutes via a metering pump. After ending the dropping, the flask for polymerization is held at 75° C. for 3 hours while the resultant is slowly stirred, and the polymerization is ended such that an anionic thermosetting acrylic resin particle dispersion (A2) having a solid amount of 42% is obtained.

In the thermosetting acrylic resin particles contained in the anionic thermosetting acrylic resin particle dispersion (A2), the volume-average particle size of is 200 nm, the glass-transition temperature is 65° C., and the weight-average molecular weight is 31,000.

(Preparation of Colored Powder Coating Material (PCA3))

—Aggregation Process—

Thermosetting acrylic resin particle dispersion (Powder coating material): 155 parts by weight (the solid content is 65 parts by weight)

Colorant dispersion (C1): 3 parts by weight (the solid content is 0.75 parts by weight)

Colorant dispersion (W1): 150 parts by weight (the solid content is 37.5 parts by weight)

The above components are sufficiently mixed and dispersed by the homogenizer (ULTRA-TURRAX T50 manufactured by IKA Corporation) in a stainless steel round flask. Next, the pH of the resultant is adjusted to 2.5 by using a 1.0% nitric acid aqueous solution. 0.70 parts by weight of a 10% polyaluminum chloride aqueous solution is added thereto, and the dispersing operation is continuously performed by the ULTRA-TURRAX.

A stirrer and a heating mantle are installed to increase the temperature of the resultant to 60° C. while appropriately adjusting the rotation frequency of the stirrer so as to sufficiently stir the slurry. After holding the resultant for 15 minutes at 60° C., 100 parts by weight of the thermosetting acrylic resin dispersion (A2) is slowly injected so that the volume-average particle size of the resultant becomes 9.5 μm.

—Coalescence Process—

After the injection, the resultant is held for 30 minutes, and the pH thereof is adjusted to 5.0 by using a 5% sodium hydroxide aqueous solution. Thereafter, the temperature thereof is increased to 90° C. and is held for 2 hours. Substantially spheroidized particles are observed by an optical microscope.

—Filtration, Washing, and Drying Process—

After the reaction ends, the solution in the flask is cooled and filtered such that a solid is obtained. Next, the solid is sufficiently washed by ion-exchange water and is then subjected to solid-liquid separation through Nutsche suction filtration such that a solid is re-obtained.

Next, the solid is re-dispersed in 3 liters of ion-exchange water at 40° C. and is stirred and washed at 300 rpm for 15 minutes. The washing operation is repeated 5 times, and the solid obtained by the solid-liquid separation through the Nutsche suction filtration is subjected to vacuum drying for 12 hours. Thereafter, 0.5 parts by weight of hydrophobic silica (a primary particle size of 16 nm) is added to 100 parts by weight of the solid such that the colored powder coating material (PCA3) made of an acrylic resin is obtained.

The volume-average particle size D50v of the powder particles of the colored powder coating material is 13.5 μm, the volume-average particle size distribution index GSDv is 1.23, and the average circularity is 0.98.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.03% by weight.

TEST EXAMPLE 6

Colored Powder Coating Material (PCE3) Made of Polyester Resin (Preparation of Thermosetting Polyester Resin (PES2))

A raw material having the following composition is put into a reaction container provided with a stirrer, a thermometer, a nitrogen gas inlet port, and a rectifier, and is subjected to a polycondensation reaction by increasing the temperature of the raw material to 240° C. while stirring the raw material under a nitrogen atmosphere.

Terephthalic acid: 494 parts by weight (70 mol %)
Isophthalic acid: 212 parts by weight (30 mol %)
Neopentyl glycol: 421 parts by weight (88 mol %)
Ethylene glycol: 28 parts by weight (10 mol %)
Trimethylolethane: 11 parts by weight (2 mol %)
Di-n-butyltin oxide: 0.5 parts by weight In the obtained thermosetting polyester resin, the glass-transition temperature is 60° C., the acid value (Av) is 7 mg KOH/g, the hydroxyl value (OHv) is 35 mg KOH/g, the weight-average molecular weight is 22,000, and the number-average molecular weight is 7000.

(Preparation of Composite Particle Dispersion (E3)) While a jacketed 3-liter reaction vessel (BJ-30N manufactured by Tokyo Rikakikai Co., LTD.) provided with a condenser, a thermometer, a water-dropping device, and an anchor blade is maintained at 40° C. in a water-circulating thermostatic bath, a mixed solvent of 180 parts by weight of ethyl acetate and 80 parts by weight of isopropyl alcohol is injected into the reaction vessel, and the following composition is injected into the resultant.

Thermosetting polyester resin (PES2): 240 parts by weight
Blocked isocyanate hardener VESTAGON B 1530 (manufactured by Evonik Japan Co., Ltd.): 60 parts by weight
Benzoin: 3 parts by weight
Acrylic oligomer (Acronal 4F, BASF Company Ltd.): 3 parts by weight After the injection, the resultant is stirred at 150 rpm using a three-one motor to be dissolved such that an oil phase is obtained. In the oil phase being stirred, 1 parts by weight of 10% by weight of an ammonia aqueous solution and 47 parts by weight of 5% by weight of a sodium hydroxide aqueous solution are dropped for 5 minutes and are mixed for 10 minutes. Thereafter, 900 parts by weight of ion-exchange water is dropped at a speed of 5 parts by weight per minute for phase inversion such that an emulsified liquid is obtained.

800 parts by weight of the obtained emulsified liquid and 700 parts by weight of the ion-exchange water are put into a 2-liter eggplant flask, and the resultant is set in an evaporator (manufactured by Tokyo Rikakikai Co., LTD.) provided with a vacuum control unit via trap balls. While rotating the eggplant flask, the resultant is heated by a hot water bath at 60° C. and is decompressed to 7 kPa while being careful of bumping such that a solvent is removed therefrom. At the time when the amount of the solvent being collected becomes 1100 parts by weight, the pressure is returned to the normal pressure, and the eggplant flask is water-cooled such that a dispersion is obtained. There is no solvent odor in the obtained dispersion. In the dispersion, the volume-average particle size of the composite particles containing the thermosetting polyester resin and the hardener is 160 nm.

Thereafter, 2% by weight of an anionic surfactant (DOWFAX 2A1 manufactured by The Dow Chemical Company, the amount of effective components is 45% by weight) is added and mixed as an effective component with respect to the resin component in the dispersion, and the concentration of the solid thereof is adjusted to 20% by weight by adding ion-exchange water. This is used as a composite particle dispersion (E3) containing the polyester resin and the hardener.

(Preparation of Thermosetting Polyester Resin Particle Dispersion (E2))

A thermosetting polyester resin particle dispersion (E4) is obtained under the same conditions as those for preparing the composite particle dispersion (E1) except that 300 parts by weight of the thermosetting polyester resin (PES2) is used and the blocked isocyanate hardener, the benzoin, and the acrylic oligomer are not added.

(Preparation of Colored Powder Coating Material (PCE3))

—Aggregation Process—

Composite particle dispersion (E3): 325 parts by weight (the solid content is 65 parts by weight)
Colorant dispersion (C1): 3 parts by weight (the solid content is 0.75 parts by weight)
Colorant dispersion (W1): 150 parts by weight (the solid content is 37.5 parts by weight)

The above components are sufficiently mixed and dispersed by the homogenizer (ULTRA-TURRAX T50 manufactured by IKA Corporation) in a stainless steel round flask. Next, the pH of the resultant is adjusted to 2.5 by using a 1.0% nitric acid aqueous solution. 0.50 parts by weight of a 10% polyaluminum chloride aqueous solution is added thereto, and the dispersing operation is continuously performed by the ULTRA-TURRAX.

A stirrer and a heating mantle are installed to increase the temperature of the resultant to 40° C. while appropriately adjusting the rotation frequency of the stirrer so as to sufficiently stir the slurry. After holding the resultant for 15 minutes at 40° C., 100 parts by weight of the thermosetting polyester resin dispersion (E4) is slowly injected so that the volume-average particle size of the resultant becomes 3.5 μm.

—Coalescence Process—

After the injection, the resultant is held for 30 minutes, and the pH thereof is adjusted to 6.0 by using a 5% sodium hydroxide aqueous solution. Thereafter, the temperature thereof is increased to 85° C. and is held for 2 hours. Substantially spheroidized particles are observed by an optical microscope.

—Filtration, Washing, and Drying Process—

After the reaction ends, the solution in the flask is cooled and filtered such that a solid is obtained. Next, the solid is sufficiently washed by ion-exchange water and is then subjected to solid-liquid separation through Nutsche suction filtration such that a solid is re-obtained.

Next, the solid is re-dispersed in 3 liters of ion-exchange water at 40° C. and is stirred and washed at 300 rpm for 15 minutes. The washing operation is repeated 5 times, and the solid obtained by the solid-liquid separation through the Nutsche suction filtration is subjected to vacuum drying for 12 hours. Thereafter, 0.5 parts by weight of hydrophobic silica (a primary particle size of 16 nm) is added to 100 parts by weight of the solid such that the colored powder coating material (PCE3) made of a polyester resin is obtained.

The volume-average particle size D50v of the powder particles of the colored powder coating material is 4.5 μm, the volume-average particle size distribution index GSDv is 1.23, and the average circularity is 0.99.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.02% by weight.

COMPARATIVE TEST EXAMPLE 1

Colored Powder Coating Material (PCEX1) Made of Polyester Resin

A colored powder coating material (PCEX1) made of a polyester resin is obtained under the same conditions as those in Test Example 2 except that 400 parts by weight of the composite particle dispersion (E1) is used and the addition of 100 parts by weight of the thermosetting polyester resin particle dispersion (E2) is not performed.

The volume-average particle size D50v of the powder particles of the colored powder coating material is 7.5 the volume-average particle size distribution index GSDv is 1.40, and the average circularity is 0.98.

The colored powder coating material (the powder particles thereof) is embedded in an epoxy resin, and the resultant is cut and the cross-sectional image of the particles is observed by a transmission electron microscope. It is confirmed that the surface of the powder particle is not coated with the resin coating portion and an additive considered as the hardener is exposed to the surface of the powder particle.

The content of aluminum ions in the colored powder coating material (the powder particles thereof) is 0.07% by weight.

COMPARATIVE TEST EXAMPLE 2

Clear Powder Coating Material (PCAX1) Made of Acrylic Resin

A clear powder coating material (PCAX1) made of an acrylic resin is obtained under the same conditions as those in Test Example 1 except that the content of the polyaluminum chloride is reduced to 0.1 parts by weight, 40 parts by weight of a 10% NTA (nitrilotriacetic acid) metal salt aqueous solution (CHELEST 70 manufactured by Chelest Co., Ltd.) are added in the coalescence process, and the pH thereof is then adjusted to 6.0 by using a 5% sodium hydroxide aqueous solution.

The volume-average particle size D50v of the powder particles of the clear powder coating material is 9.0 the volume-average particle size distribution index GSDv is 1.53, and the average circularity is 0.99.

The clear powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the powder particles of the clear powder coating material is 0.001% by weight.

COMPARATIVE TEST EXAMPLE 3

Clear Powder Coating Material (PCAX2) Made of Acrylic Resin

A clear powder coating material (PCAX2) made of an acrylic resin is obtained under the same conditions as those in Test Example 1 except that the content of the polyaluminum chloride is increased to 3 parts by weight.

The volume-average particle size D50v of the powder particles of the clear powder coating material is 8.2 μm, the volume-average particle size distribution index GSDv is 1.30, and the average circularity is 0.95.

The clear powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the powder particles of the clear powder coating material is 0.25% by weight.

COMPARATIVE TEST EXAMPLE 4

Colored Powder Coating Material (PCEX2) Made of Polyester Resin

A colored powder coating material (PCEX2) made of a polyester resin is obtained under the same conditions as those in Test Example 6 except that the content of the polyaluminum chloride is reduced to 0.2 parts by weight, 40 parts by weight of a 10% NTA (nitrilotriacetic acid) metal salt aqueous solution (CHELEST 70 manufactured by Chelest Co., Ltd.) are added in the coalescence process, and the pH thereof is then adjusted to 6.0 by using a 5% sodium hydroxide aqueous solution. The volume-average particle size D50v of the powder particles of the colored powder coating material is 5.0 μm, the volume-average particle size distribution index GSDv is 1.55, and the average circularity is 0.99.

The clear powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the powder particles of the clear powder coating material is 0.0016% by weight.

TEST EXAMPLE 7

Clear Powder Coating Material (PCAX2) Made of Polyester Resin

A colored powder coating material (PCEX4) made of a polyester resin is obtained under the same conditions as those in Test Example 6 except that the content of the polyaluminum chloride is increased to 2 parts by weight. The volume-average particle size D50v of the powder particles of the colored powder coating material is 5.5 μm, the volume-average particle size distribution index GSDv is 1.30, and the average circularity is 0.97.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.22% by weight.

TEST EXAMPLE 8

Colored Powder Coating Material (PME1) Made of Polyester Resin

A colored powder coating material (PME1) is obtained in the same method as that of the colored powder coating material (PGE1) in Test Example 2 except that 306.5 parts by weight of the composite particle dispersion (E1) is used and 4.8 parts by weight of the colorant dispersion (M1) is used instead of the colorant dispersion (C1).

The volume-average particle size D50v of the powder particles of the colored powder coating material is 6.4 μm, the volume-average particle size distribution index GSDv is 1.23, and the average circularity is 0.98.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.1% by weight.

TEST EXAMPLE 9

Colored Powder Coating Material (PME2) Made of Polyester Resin

A colored powder coating material (PME2) is obtained in the same method as that of the colored powder coating material (PCE1) in Test Example 2 except that 305 parts by weight of the composite particle dispersion (E1) is used and 6 parts by weight of the colorant dispersion (M2) is used instead of the colorant dispersion (C1).

The volume-average particle size D50v of the powder particles of the colored powder coating material is 6.6 the volume-average particle size distribution index GSDv is 1.22, and the average circularity is 0.98.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.1% by weight.

TEST EXAMPLE 10

Colored Powder Coating Material (PYE1) Made of Polyester Resin

A colored powder coating material (PYE1) is obtained in the same method as that of the colored powder coating material (PCE1) in Test Example 2 except that 302.5 parts by weight of the composite particle dispersion (E1) is used and 8 parts by weight of a colorant dispersion (Y1) is used instead of the colorant dispersion (C1).

The volume-average particle size D50v of the powder particles of the colored powder coating material is 6.8 the volume-average particle size distribution index GSDv is 1.24, and the average circularity is 0.96.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.12% by weight.

TEST EXAMPLE 11

Colored Powder Coating Material (PKE1) Made of Polyester Resin

A colored powder coating material (PKE1) is obtained in the same method as that of the colored powder coating material (PCE1) in Test Example 2 except that 309 parts by weight of the composite particle dispersion (E1) is used and 2.8 parts by weight of a colorant dispersion (K1) is used instead of the colorant dispersion (C1).

The volume-average particle size D50v of the powder particles of the colored powder coating material is 6.5 the volume-average particle size distribution index GSDv is 1.22, and the average circularity is 0.98.

The colored powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the colored powder coating material (the powder particles thereof) is 0.09% by weight.

<Evaluations>

(Production of Coating Film Sample of Powder Coating Material)

A test panel of a zinc phosphate-treated steel sheet is coated with the powder coating material obtained in each of the examples by an electrostatic coating method, and the resultant is then heated (baked) at a heating temperature of 180° C. for a heating time of 1 hour such that a coating film sample having a thickness of 30 μm is obtained.

(Evaluation of Smoothness of Coating Film)

The center-line average roughness (hereinafter, referred to as "Ra", unit: μm) of the surface of the coating film sample is measured by using a surface profiler surface roughness meter (SURFCOM 1400A of Tokyo Seimitsu Co., Ltd.). As the value of the Ra increases, the smoothness of the surface decreases, and 0.5 μm is a good level.

(Evaluation of Glossiness of Coating Film)

The 60° specular gloss value (unit: %) of the surface of the coating film sample is measured by using a gloss meter (micro-TRI-gloss of BYK-Gardner). As the value thereof increases, glossiness increases, and 90% or higher is a good level.

(Evaluation of Blocking Resistance)

The powder coating material obtained in each of the examples is stored in a thermo-hygrostat bath in which the temperature and the humidity are respectively controlled to 50° C. and 50 RH %, for 17 hours and is sieved by a vibrating sieve, and thereafter the amount of the powder coating material being passed through 200 meshes (an opening of 75 micrometers) is examined. Evaluation is performed based on the following criteria.

G1 (O): a passage amount of 90% or higher

NG (X): a passage amount of less than 90%

Details and evaluation results of each of the Examples are listed in Table 1.

TABLE 1

| | | Test Example 1 | Test Example 2 | Test Example 3 | Test Example 4 | Comparative Test Example 1 | Comparative Test Example 2 | Comparative Test Example 3 |
|---|---|---|---|---|---|---|---|---|
| Characteristic of powder coating material | Sample ID | PCA1 | PCE1 | PCE2 | PCA2 | PCEX1 | PCAX1 | PCAX2 |
| | D50v (μm) | 5.9 | 6.5 | 6.8 | 7.0 | 7.5 | 9.0 | 8.2 |
| | GSDv | 1.20 | 1.24 | 1.22 | 1.35 | 1.40 | 1.53 | 1.30 |
| | Average circularity | 0.99 | 0.98 | 0.99 | 0.97 | 0.98 | 0.99 | 0.95 |
| | Presence of resin coating portion | Yes | Yes | Yes | Yes | No | Yes | Yes |
| | Content of metal ion (%) | 0.08 | 0.1 | 0.005 | 0.17 | 0.007 | 0.001 | 0.25 |
| Evaluation | Surface roughness Ra of coating film (μm) | 0.3 | 0.3 | 0.2 | 0.4 | 0.6 | 0.7 | 0.8 |
| | Glossiness of coating film % | 96 | 95 | 97 | 95 | 92 | 87 | 77 |
| | Blocking resistance of powder coating material | G1(O) | G1(O) | G1(O) | G1(O) | NG(X) | G1(O) | G1(O) |

| | | Test Example 5 | Test Example 6 | Comparative Test Example 4 | Test Example 7 | Test Example 8 | Test Example 9 | Test Example 10 | Test Example 11 |
|---|---|---|---|---|---|---|---|---|---|
| Characteristic of powder coating material | Sample ID | PCA3 | PCE3 | PCEX2 | PCE4 | PME1 | PME2 | PYE1 | PKE1 |
| | D50v (μm) | 13.5 | 4.5 | 5.0 | 5.5 | 6.4 | 6.6 | 6.8 | 6.5 |
| | GSDv | 1.23 | 1.23 | 1.55 | 1.30 | 1.23 | 1.22 | 1.24 | 1.22 |
| | Average circularity | 0.98 | 0.99 | 0.99 | 0.97 | 0.98 | 0.98 | 0.96 | 0.98 |
| | Presence of resin coating portion | Yes | Yes | Yes | Yes | Yes | Yes | Yes | Yes |
| | Content of metal ion (%) | 0.03 | 0.02 | 0.0016 | 0.22 | 0.1 | 0.1 | 0.12 | 0.09 |
| Evaluation | Surface roughness Ra of coating film (μm) | 0.3 | 0.1 | 0.3 | 0.6 | 0.3 | 0.3 | 0.4 | 0.2 |
| | Glossiness of coating film % | 95 | 98 | 95 | 90 | 95 | 94 | 91 | 95 |
| | Blocking resistance of powder coating material | G1(O) | G1(O) | NG(X) | G1(O) | G1(O) | G1(O) | G1(O) | G1(O) |

From the above results, it is seen that, compared to Comparative Test Examples, in Test Examples, even when the volume-average particle size is reduced to be equal to or smaller than 15 μm, a coating film having a low surface roughness and a high glossiness is obtained. In Test Examples, compared to Comparative Test Examples, it is seen that the blocking resistance of the powder coating material is also good.

Therefore, it is seen that, compared to the powder coating materials of Comparative Test Examples, the powder coating materials of Test Examples form a coating film having high smoothness and have high storage properties even when the powder particles are reduced in diameter.

From the above description, it is seen that when the powder coating material according to this exemplary embodiment is applied to the powder coating apparatus according to this exemplary embodiment, powder coating by forming a coating film having a desired thickness with good productivity is obtained, and a coating film having high smoothness with a small amount of the material is obtained even when the powder particles are reduced in diameter.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder coating apparatus comprising:

a transport device that transports an object to be coated; and an applying unit, a heating device, and a control device, wherein the applying unit is disposed to oppose a surface to be coated of the transported object to be coated, applies a charged thermosetting powder coating material onto a surface to be coated of the object to be coated, and includes at least one applying section each having a cylindrical or columnar applying member that rotates in the same direction as a transport direction of the object to be coated and causes the powder coating material that adheres to a surface of the applying section to be transferred and applied onto the surface to be coated of the object to be coated by a potential difference between the applying section and the surface to be coated of the object to be coated, and a supplying section associated with each applying section, each supplying section comprising from 2 to 5 cylindrical or columnar supplying members arranged along a circumferential direction of the applying member, the supplying section supplying the powder coating material onto a surface of the applying member, wherein the heating device heats a powder particle layer of the powder coating material applied onto the surface to be coated of the object to be coated, so as to be thermally cured, and wherein the control device controls a speed ratio between a transport speed of the object to be coated and a rotation speed of the applying member so that a thickness of the powder particle layer of the powder coating material applied by the applying unit onto the surface to be coated of the object to be coated becomes a predetermined thickness.

2. The powder coating apparatus according to claim 1, wherein the applying unit includes a plurality of applying units arranged in the transport direction of the object to be coated.

3. The powder coating apparatus according to claim 1, wherein the applying member includes a conductive roll and a resistive layer provided on an outer circumferential surface of the conductive roll.

4. The powder coating apparatus according to claim 3, wherein the resistive layer has a volume resistivity of from $10^5$ Ωcm to $10^{10}$ Ωcm.

5. The powder coating apparatus according to claim 3, wherein a thickness of the resistive layer is from 20 μm to 100,000 μm.

6. The powder coating apparatus according to claim 2, wherein, in the plurality of applying units, at least one applying unit is an applying unit that applies the powder coating material having a different color from those of the other applying units onto the surface to be coated of the object to be coated.

7. The powder coating apparatus according to claim 2, wherein, as the heating device, a plurality of heating devices are provided each of which heats the powder particle layer of the powder coating material applied by the plurality of applying units onto the surface to be coated of the object to be coated so as to be thermally cured.

8. The powder coating apparatus according to claim 1, wherein the powder coating material includes a core which contains a thermosetting resin and a hardener, and a resin coating portion which coats a surface of the core.

9. The powder coating apparatus according to claim 1, wherein a volume particle size distribution index GSDv of the powder coating material is equal to or less than 1.50.

10. The powder coating apparatus according to claim 1, wherein a volume-average particle size D50v of the powder coating material is from 1 μm to 25 μm.

11. The powder coating apparatus according to claim 8, wherein a coating ratio of the resin coating portion of the powder coating material is from 30% to 100%.

12. The powder coating apparatus according to claim 1, wherein the powder coating material contains a metal having divalent or higher charges.

13. The powder coating apparatus according to claim 12, wherein a content of the metal having divalent or higher charges is from 0.002% by weight to 0.2% by weight with respect to a total content of the powder particles.

14. A non-transitory computer readable medium storing a program for controlling a powder coating apparatus that includes a transport device that transports an object to be coated, an applying unit, a heating device, and a control device, causing a computer to function as:

a unit that controls a speed ratio between a transport speed of the object to be coated and a rotation speed of an applying member so that a thickness of a powder particle layer of a powder coating material applied by the applying unit onto a surface to be coated of the object to be coated becomes a predetermined thickness, wherein the applying unit is disposed to oppose the surface to be coated of the transported object to be coated, applies a charged thermosetting powder coating material onto the surface to be coated of the object to be coated, and includes at least one applying section each having a cylindrical or columnar applying member that rotates in the same direction as a transport direction of the object to be coated and causes the powder coating material that adhere to a surfaces of the applying section to be transferred and applied onto the surface to be coated of the object to be coated by a potential difference between the applying section and the surface to be coated of the object to be coated, and a supplying section associated with each applying section, each supplying section comprising from 2 to 5 cylindrical or columnar supplying members arranged along a circumferential direction of the applying member, the supplying section supplying the powder coating material onto the surface of the applying member, wherein the heating device heats the powder particle layer of the powder coating material applied onto the surface to be coated of the object to be coated, so as to be thermally cured, and wherein the control device controls the speed ratio between the transport speed of the object to be coated and the rotation speed of the applying member so that a thickness of the powder particle layer of the powder coating material applied by the applying unit onto the surface to be coated of the object to be coated becomes a predetermined thickness.

* * * * *